US012733692B2

(12) United States Patent
Fujiwara et al.

(10) Patent No.: US 12,733,692 B2
(45) Date of Patent: Sep. 15, 2026

(54) MULTI-KNITTED WEARABLE GARMENT

(71) Applicant: OKAMOTO CORPORATION, Kitakatsuragi-gun (JP)

(72) Inventors: Takuya Fujiwara, Osaka (JP); Masato Fukiage, Osaka (JP); Yu Wakai, Osaka (JP); Taishi Shirahase, Osaka (JP)

(73) Assignee: OKAMOTO CORPORATION, Nara (JP)

( * ) Notice: Subject to any disclaimer, the term of this patent is extended or adjusted under 35 U.S.C. 154(b) by 0 days.

(21) Appl. No.: 18/729,792

(22) PCT Filed: Jan. 20, 2023

(86) PCT No.: PCT/JP2023/001658
§ 371 (c)(1),
(2) Date: Jul. 17, 2024

(87) PCT Pub. No.: WO2023/140346
PCT Pub. Date: Jul. 27, 2023

(65) Prior Publication Data

US 2025/0089815 A1 Mar. 20, 2025

(30) Foreign Application Priority Data

Jan. 24, 2022 (JP) ..... 2022-008604

(51) Int. Cl.
*A41B 11/00* (2006.01)

(52) U.S. Cl.
CPC ..... *A41B 11/00* (2013.01)

(58) Field of Classification Search
CPC ..... A41B 11/00; A41B 17/00; D04B 1/00; D04B 1/02; D04B 1/14
See application file for complete search history.

(56) References Cited

U.S. PATENT DOCUMENTS 5,555,565 A * 9/1996 Gallagher, Jr. ..... A41B 11/00 66/185
7,614,257 B2 11/2009 Araki et al.
(Continued)

FOREIGN PATENT DOCUMENTS

JP 3055454 U 10/1998
JP 2001-207303 A 8/2001
(Continued)

OTHER PUBLICATIONS

International Search Report issued in PCT/JP2023/001658, and written opinion, Apr. 4, 2023, 9 pages including English translation of the search report.
(Continued)

*Primary Examiner* — Uyen T Nguyen
(74) *Attorney, Agent, or Firm* — HSML P.C.

(57) ABSTRACT

Problems for the present invention to be solved is to provide a multiply knitted wearable garment that has excellent heat retention properties and hardly causes stuffiness in a wearing part of a wearer. The multi-knitted wearable garment 100 according to the present invention includes at least one first knitted layer O11 and at least one second knitted layer I11. The first knitted fabric layer includes a region formed with a bulky knitted fabric. The second knitted fabric layer includes a region formed with a water-absorbing and quick-drying knitted fabric. The water-absorbing and quick-drying knitted fabric has a higher water-absorbing and quick-drying properties than the region formed with the bulky knitted fabric. The multi-knitted wearable garment preferably further includes at least one third knitted fabric layer O12. The third knitted fabric layer includes a region formed with a partially bulky knitted fabric.

16 Claims, 12 Drawing Sheets

(56) References Cited

U.S. PATENT DOCUMENTS

| | | | | |
|---|---|---|---|---|
| 2003/0089136 | A1* | 5/2003 | Lynch | D04B 9/40<br>66/187 |
| 2009/0095026 | A1 | 4/2009 | Araki et al. | |
| 2016/0206462 | A1* | 7/2016 | Iida | A61F 5/0111 |
| 2018/0014578 | A1* | 1/2018 | Ward | B65D 25/54 |
| 2019/0203390 | A1* | 7/2019 | Idobata | D04B 1/24 |
| 2021/0047757 | A1* | 2/2021 | Cleveland | A41B 11/00 |

FOREIGN PATENT DOCUMENTS

| | | | |
|---|---|---|---|
| JP | 2004-36059 | A | 2/2004 |
| JP | 3121397 | U | 4/2006 |
| JP | 2009-91698 | A | 4/2009 |
| JP | 2010-138532 | A | 6/2010 |
| JP | 2011-256508 | A | 12/2011 |
| JP | 2021-116509 | A | 8/2021 |

OTHER PUBLICATIONS

Office Action issued in corresponding Japanese application No. 2023-575308, Mar. 18, 2025, and machine translation (9 pages).

* cited by examiner

| | | 320N=8 Wale×40 | | | | | | | | | | | | | | | | |
|---|---|---|---|---|---|---|---|---|---|---|---|---|---|---|---|---|---|---|
| | | Wale | | | | | | | | | | | | | | | | |
| | | 1 | 2 | 3 | 4 | 5 | 6 | 7 | 8 | ~ | 313 | 314 | 315 | 316 | 317 | 318 | 319 | 320 |
| Course | 1F(SCY) | ○ | ○ | ○ | ○ | ○ | ○ | ○ | ○ | | ○ | ○ | ○ | ○ | ○ | ○ | ○ | ○ |
| | 2F(WN) | × | × | × | ○ | × | × | × | ○ | | × | × | × | ○ | × | × | × | ○ |
| | 3F(SCY) | ○ | ○ | ○ | ○ | ○ | ○ | ○ | ○ | | ○ | ○ | ○ | ○ | ○ | ○ | ○ | ○ |
| | 4F(WN) | × | ○ | × | × | × | ○ | × | × | ~ | × | ○ | × | × | × | ○ | × | × |
| | 1F(SCY) | ○ | ○ | ○ | ○ | ○ | ○ | ○ | ○ | | ○ | ○ | ○ | ○ | ○ | ○ | ○ | ○ |
| | 2F(WN) | × | × | × | ○ | × | × | × | ○ | | × | × | × | ○ | × | × | × | ○ |
| | 3F(SCY) | ○ | ○ | ○ | ○ | ○ | ○ | ○ | ○ | | ○ | ○ | ○ | ○ | ○ | ○ | ○ | ○ |
| | 4F(WN) | × | ○ | × | × | × | ○ | × | × | | × | ○ | × | × | × | ○ | × | × |
| Knit=○, Tuck=× | | | | | | | | | | | | | | | | | | |

MULTI-KNITTED WEARABLE GARMENT

TECHNICAL FIELD

The present invention relates to a multi-knitted wearable garment that can be worn at least on a foot (a portion from an ankle to a toe), such as a sock (a sock, a high-sock, or the like), a stocking, tights, or the like.

BACKGROUND ART

In the past, the following technique has been proposed (see, for example, JP2010-138532): "a double sock formed by overlapping an inner sock body and an outer sock body and sewing the toe portion of the inner sock body to the toe portion of the outer sock body after knitting a sock knit body by providing pile on the inner surfaces of the toe portion, foot insertion portion and leg insertion portion of each of the inner sock body and the outer sock body, for the sock knit body in which the leg insertion portion of the inner sock body and the leg insertion portion of the outer sock body are connected via connecting yarn, the inner sock body including a toe portion, a foot portion and a leg portion, the outer sock body including a toe portion, a foot portion and a leg portion". Such a double sock is excellent in heat retention properties, and is often worn particularly in a period of low temperature.

PRIOR ART DOCUMENT

Patent Document 1: Japanese Patent Application Laid-Open No. 2010-138532

DISCLOSURE OF INVENTION

Technical Problem

When a wearer of the above-described double sock engages relatively vigorous exercise or enters a warm room, his or her foot is likely to get stuffy.

Problems for the present invention to be solved is to provide a multi-knitted wearable garment that has excellent heat retention properties and hardly causes stuffiness in a wearing part of a wearer.

Solution to Problem

A multi-knitted wearable garment according to a first aspect of the present invention includes at least one first knitted fabric layer and at least one second knitted fabric layer. The first knitted fabric layer includes a region formed with a bulky knitted fabric. Note that the bulky knitted fabric has higher heat retention properties than the water-absorbing and quickly-drying knitted fabric or a lower thermal conductivity than the water-absorbing and quickly-drying knitted fabric. The second knitted fabric layer includes a region formed with a water-absorbing and quick-drying knitted fabric. Note that the water-absorbing and quick-drying knitted fabric has higher water-absorbing and quick-drying properties than the region formed with the bulky knitted fabric. The water-absorbing and quick-drying knitted fabric may or may not have air permeability.

As described above, the multi-knitted wearable garment has not only heat retaining properties but also water-absorbing and quick-drying properties. Thus, the multi-knitted wearable garment is excellent in heat retention properties, and the wearing portion(s) of a person wearing the multi-knitted wearable garment can be made less likely to get stuffy. In addition, when the bulky knitted fabric has a lower thermal conductivity than the water-absorbing and quick-drying knitted fabric, the bulky knitted fabric makes it possible to reduce or inhibit the loss of heat from the area where the garment is worn to the floor or shoes, which are cooler than body temperature, through thermal conduction, or makes it possible to reduce or inhibit the transferring of the coldness of the floor or shoes to the feet, as compared with the water-absorbing and quick-drying knitted fabric. Even when the floor, shoes, or the like, which is in direct contact with the multi-knitted wearable garment, is cold, it is possible to prevent the heat of the foot from being taken away by the floor, shoes, or the like, whose temperature is lower than the body temperature, through thermal conduction, or to prevent the cold of the floor or shoes from being transferred to the foot.

A multi-knitted wearable garment according to a second aspect of the present invention is the multi-knitted wearable garment according to the first aspect, wherein the multi-knitted wearable garment can be worn at least on a foot. The first knitted fabric layer constitutes a bottom covering portion that covers a bottom side of the foot.

This allows the multi-knitted wearable garment to reduce or inhibit heat release from the bottom side of the foot.

A multi-knitted wearable garment according to a third aspect of the present invention is the multi-knitted wearable garment according to the second aspect, wherein the first knitted fabric layer is positioned in an outermost layer of the bottom covering portion.

Thus, even when a portion directly in contact with the multi-knitted wearable garment, such as a floor or a shoe, is cold, the multi-knitted wearable garment makes it possible to prevent heat of the foot from being taken by the floor or the shoe having a temperature lower than the body temperature through heat conduction, or to prevent the cold of the floor or the shoe from being transferred to the foot. In addition, the multi-knitted wearable garment can reduce the occurrence of discomfort in the foot.

A multi-knitted wearable garment according to a fourth aspect of the present invention is the multi-knitted wearable garment according to any one of the first to third aspects, which can be worn at least on a foot. The first knitted fabric layer and the second knitted fabric layer are provided only in the tip covering portion. The tip covering part covers the tip of the foot. Note that the tip portion of the foot is a portion of the toe, and more specifically, is a portion on the front side of the MTP joint.

It is known that the tip portion of the foot is the end of the foot and is therefore particularly susceptible to cold in the lower body. In general, a space relatively larger than that of the tip portion of the foot is provided in the tip portion of the shoe, whereas a space between the shoe and the foot is relatively small in portions other than the tip portion of the shoe. Thus, when the portions other than the tip covering portion are formed into a single structure or the like, the multi-knitted wearable garment can efficiently keep the temperature of the tip portion of the foot, which is particularly likely to cool, without making the foot tight in the shoe.

A multi-knitted wearable garment according to a fifth aspect of the present invention is the multi-knit wearable garment according to any one of the first to fourth aspects, in which a bulky portion of the bulky knitted fabric extends inward.

Thus, even when the portion with which the multi-knitted wearable garment is in direct contact is cold, the multi-knitted wearable garment can reduce the thermal transfer area of the cold and can enjoy the heat insulation effect by the air layer, thereby making it less likely for the cold to be transferred to the foot.

A multi-knitted wearable garment according to a sixth aspect of the present invention is the multi-knitted wearable garment according to the first aspect, further including at least one third knitted fabric layer. The third knitted fabric layer includes a region formed with a partially bulky knitted fabric.

A bulky region and a low bulk region are formed in the partially bulky knitted fabric. Every time the partially bulky knitted fabric is stepped on, the bulky region is stepped on and its bulk is reduced, and the air contained in the bulky region and the air above the low-bulk fabric region flow and diffuse. This allows the multi-knitted wearable garment to make the air warmed in the wearable garment flow and diffuse when walking or the like, thereby making it possible to warm a relatively wide foot region. In addition, the air in the system, the humidity of which has been increased by the flow and diffusion of the air, is gradually discharged to the outside of the system, thereby making it less likely for the foot of the wearer to get stuffy.

A multi-knitted wearable garment according to a seventh aspect of the present invention is the multi-knitted wearable garment according to the sixth aspect, wherein a bulky portion of the partially bulky knitted fabric extends inward.

Thus, even when the portion, such as a floor or a shoe, with which the multi-knitted wearable garment is in direct contact is cold, the multi-knitted wearable garment can reduce the thermal transfer area of the cold and can enjoy the heat insulation effect by the air layer, thereby making it less likely for the cold to be transferred to the foot.

A multi-knitted wearable garment according to an eighth aspect of the present invention is the multi-knitted wearable garment according to the sixth aspect or the seventh aspect, in which the third knitted fabric layer is knitted by pseudo pile knitting formed by interknitting (A) a plain knitting course with core-sheath yarn having stretchability and bulkiness in which sheath yarn covers core yarn and (B) a tuck knitting course with crimped yarn having stretchability and bulkiness.

This allows the multi-knitted wearable garment to provide a heat insulation effect by the air layer, thereby making it less likely for the cold to be transferred to the foot when a portion, such as a floor or a shoe, with which the multi-knitted wearable garment is in direct contact is cold.

A multi-knitted wearable garment according to a ninth aspect of the present invention is the multi-knitted wearable garment according to any one of the sixth to eighth aspects, which can be worn at least on a foot. The third knitted fabric layer constitutes a bottom covering portion that covers a bottom side of the foot.

This allows the multi-knitted wearable garment to provide a heat insulation effect by the air layer, thereby making it less likely for the cold to be transferred to the foot when a portion, such as a floor or a shoe, with which the multi-knitted wearable garment is in direct contact is cold.

A multi-knitted wearable garment according to a tenth aspect of the present invention is the multi-knitted wearable garment according to any one of the sixth to ninth aspects, wherein the partially bulky knitted fabric includes a bulky region and a low-bulk region. The low-bulk region is less bulky than the bulky region.

Thus, every time the partially bulky knitted fabric is stepped on, the bulky region is stepped on and its bulk is reduced, thereby causing the air contained in the bulky region and the air above the low-bulk fabric region to flow and diffuse. This allows the multi-knitted wearable garment to make the air warmed in the wearable garment flow and diffuse during walking or the like, thereby warming a relatively wide foot region. In addition, since the air in the system with increased humidity is gradually discharged to the outside of the system, the foot of the wearer can be made less likely to get stuffy.

A multi-knitted wearable garment according to an eleventh aspect of the present invention is the multi-knitted wearable garment according to the tenth aspect, in which the low bulk region is adjacent to at least two of the bulky regions. In such a case, both the bulky region and the low-bulk region may be band-shaped, and the low-bulk region may be adjacent to the bulky region on both sides in a lateral direction.

This allows the multi-knitted wearable garment to enhance the air flow and diffusion action of the bulky region on the air above the low-bulk region, thereby further flowing and diffusing the air in the system.

A multi-knitted wearable garment according to a twelfth aspect of the present invention is the multi-knitted wearable garment according to any one of the sixth to eleventh aspects, which can be worn at least on a foot. The first knitted layer, the second knitted layer, and the third knitted layer are provided only in the tip covering portion. The tip covering part covers the tip of the foot. The tip of the foot is a portion of the toe, and more specifically, is a portion on the front side of the MTP joint.

It is known that the tip portion of the foot is the end of the foot and is therefore particularly susceptible to cold in the lower body. In general, a space relatively larger than that of the tip portion of the foot is provided in the tip portion of the shoe, whereas a space between the shoe and the foot is relatively small in portions other than the tip portion of the shoe. Thus, when the portions other than the tip covering portion are formed into a single structure or the like, the multi-knitted wearable garment can efficiently keep the temperature of the tip portion of the foot, which is particularly likely to cool, without making the foot tight in the shoe and further can warm a relatively large area of the tip of the foot, thus making it less likely for the wearer's foot tip to become stuffy.

A multi-knitted wearable garment according to a thirteenth aspect of the present invention is the multi-knitted wearable garment according to the twelfth aspect, in which the first knitted fabric layer is an interwoven fabric layer of (a) core-sheath yarn having stretchability and bulkiness in which sheath yarn covers core yarn, and (b) crimped yarn having stretchability and bulkiness. The second knitted fabric layer is an interwoven fabric layer of (a) core-sheath yarn having stretchability and bulkiness in which sheath yarn covers core yarn, and water-absorbing and quick-drying yarn. The third knitted fabric layer is an interwoven fabric layer of (a) core-sheath yarn having stretchability and bulkiness in which sheath yarn covers core yarn, and (b) crimped yarn having stretchability and bulkiness.

This allows the multi-knitted wearable garment to efficiently absorb sweat generated from the foot and quickly dry the sweat and further to efficiently and positively warm the foot of the wearer by using moisture of the vaporized sweat.

A multi-knitted wearable garment according to a fourteenth aspect of the present invention is the multi-knitted wearable garment tool according to any one of the first to thirteenth aspects, further including at least one fourth knitted fabric layer. The fourth knitted fabric layer includes a region formed with a moisture-absorbent heat-generating knitted fabric having moisture-absorbent heat-generating properties. The moisture-absorbent heat-generating knitted fabric is knitted with yarn having moisture-absorbent heat-generating properties. The water-absorbing and quick-drying knitted fabric is knitted with yarn containing water-absorbing and quick-drying yarn. One of the second knitted fabric layer and the fourth knitted fabric layer is positioned at the innermost layer.

This allows the multi-knitted wearable garment to efficiently absorb sweat generated from the foot and quickly dry the sweat and further to efficiently and positively warm the foot of the wearer by using moisture of the vaporized sweat.

A multi-knitted wearable garment according to a fifteenth aspect of the present invention is the multi-knitted wearable garment according to any one of the first to fourteenth aspects, in which the water-absorbing and quick-drying knitted fabric is knitted with front yarn and back yarn. The front yarn includes yarn having moisture-absorbent heat-generating properties or a water absorbing quick drying yarn. When the front yarn includes yarn having moisture-absorbent heat-generating properties, the back yarn includes water-absorbing and quick-drying yarn, and when the front yarn includes water-absorbing and quick-drying yarn, the back yarn includes yarn having moisture-absorbent heat-generating properties.

This allows the multi-knitted wearable garment to absorb sweat generated from the foot and quickly dry the sweat by the same knitted fabric and further to actively warm the foot of the wearer by using moisture of the vaporized sweat.

A multi-knitted wearable garment according to a sixteenth aspect of the present invention is the multi-knitted wearable garment according to any one of the first to fifteenth aspects, in which the water-absorbing and quick-drying knitted fabric is an interwoven fabric of yarn having moisture-absorbent and heat-generating properties and water-absorbing and quick-drying yarn.

Thus, the multi-knitted wearable garment can enjoy not only the effect of the water-absorbing and quick-drying properties but also the effect of the moisture-absorbing and heat-generating properties.

A multi-knitted wearable garment according to a seventeenth aspect of the present invention is the multi-knitted wearable garment according to any one of the first to sixteenth aspects, in which the bulky knitted fabric is a knitted fabric having pile knitting. The pile portion of the pile knitting faces the other knitted fabric layer.

Thus, even when the portion, such as a floor, with which the multi-knitted wearable garment is in direct contact is cold, the multi-knitted wearable garment can reduce the thermal transfer area of the cold and can enjoy the heat insulation effect by the air layer, thereby making it less likely for the cold to be transferred to the foot.

REFERENCE SIGNS LIST

100 Double-knitted sock (multi-knitted wearable garment)
112 Bottom-side covering portion (bottom covering portion)
200 Double-knitted tights (multi-knitted wearable garment)
212 Bottom-side covering portion (bottom covering portion)
I11 Inner layer portion of an instep-side covering portion (second knitted layer, fourth knitted layer, innermost layer)
I12 Inner layer portion of the bottom-side covering portion (second knitted fabric layer, fourth knitted fabric layer, innermost layer)
O11 Outer layer portion of the instep-side covering portion (first knitted fabric layer, outermost layer)
O12 Outer layer portion of the bottom-side covering portion (third knitted fabric layer)
PB Bulky portion (bulky portion, pile portion)
RL Low-bulk region
RP Bulky region
TP Tip covering portion

DESCRIPTION OF EMBODIMENTS

Configuration of Multi-Knitted Wearable Garment According to Embodiment of the Present Invention A multi-knitted wearable garment according to an embodiment of the present invention is a wearable garment having a multi-layer structure to be worn at least on a foot, and is, for example, a sock (a foot cover, a sock, or a high-sock), a stocking, tights, or the like. The "foot" mentioned here is a part from an ankle to a toe. Examples of the multi-knitted wearable garment according to the embodiment of the present invention include a double-knitted sock 100 shown in FIGS. 1 to 3 and double-knitted tights 200 shown in FIG. 10. Hereinafter, the double-knitted sock 100 will be described in detail as a first embodiment, the double-knitted tights 200 will be described in detail as a second embodiment, and configurations that are allowed in the present invention will be described.

First Embodiment

Figure 1:
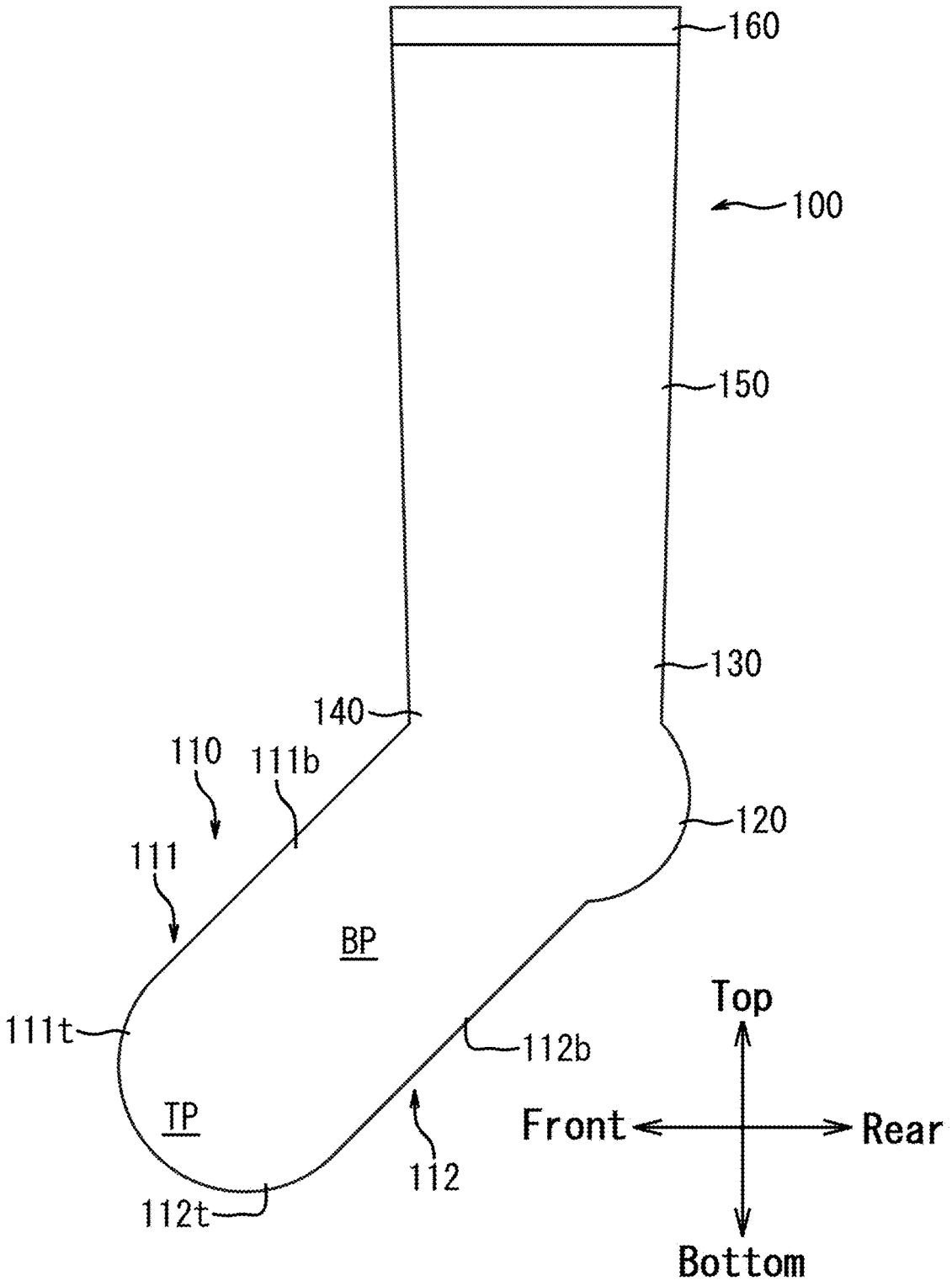
FIG. 1 is a side view of a double-knitted sock according to a first embodiment of the present invention.
Figure 2:
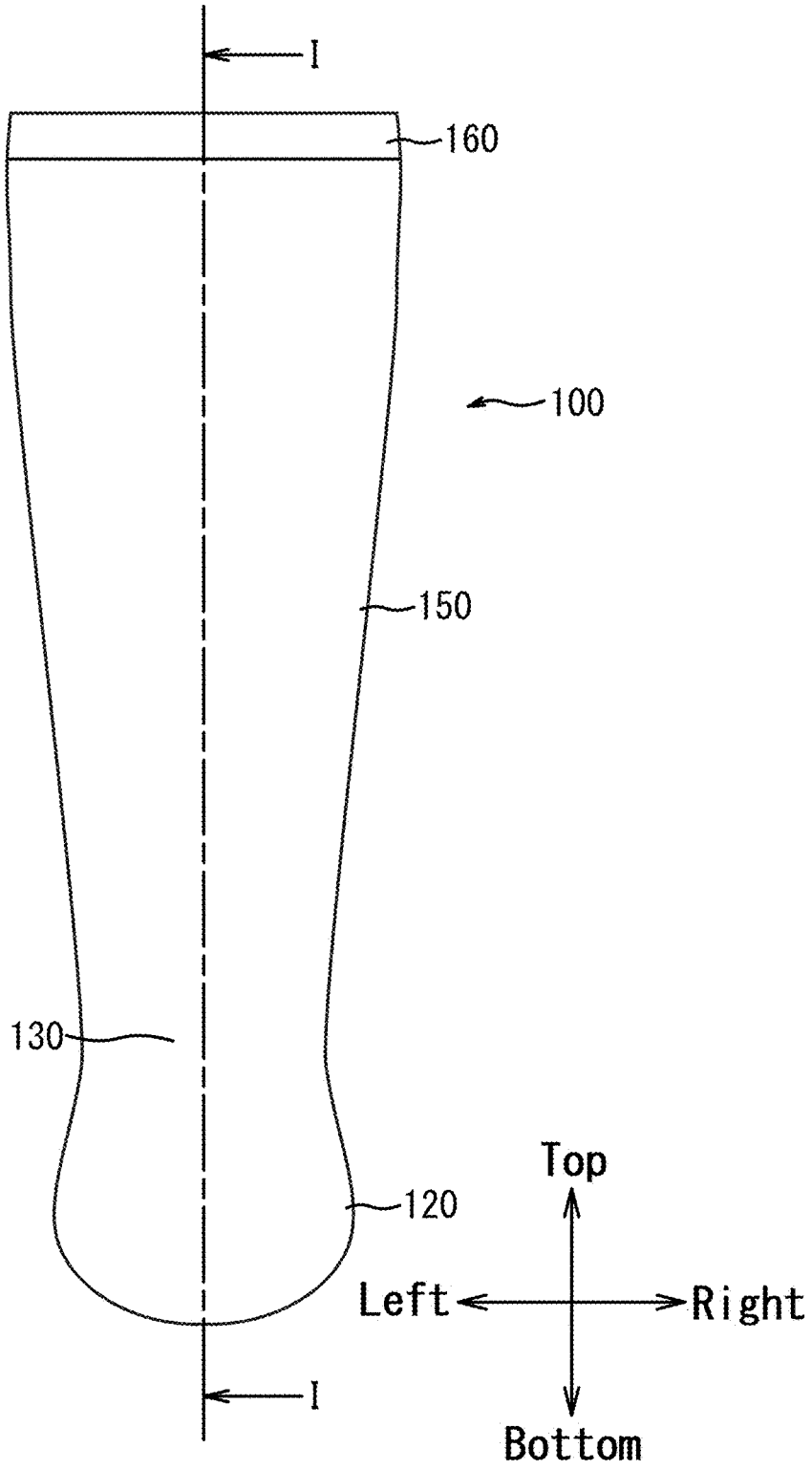
FIG. 2 is a rear view of the double-knitted sock according to the first embodiment of the present invention when worn.
Figure 3:
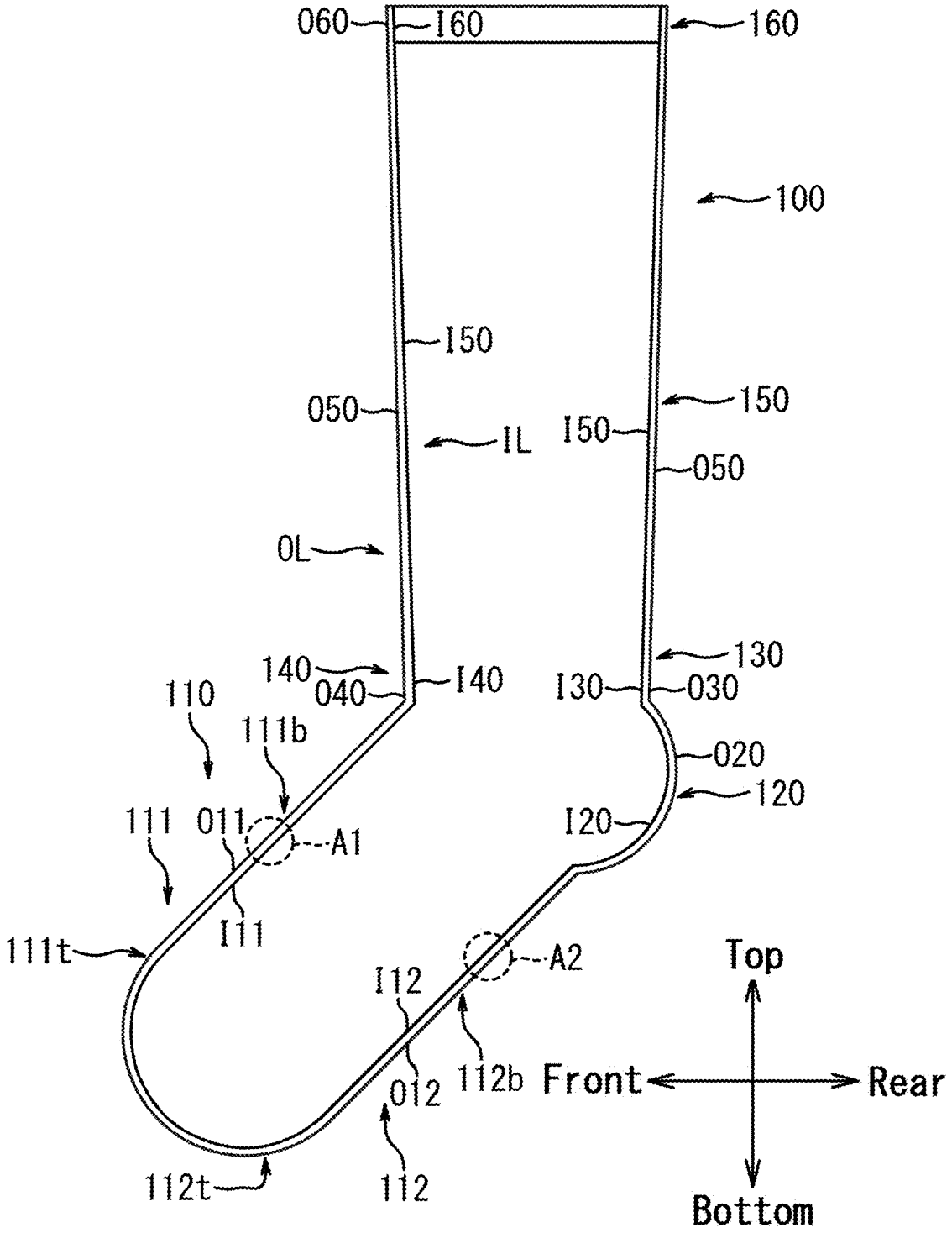
FIG. 3 is a sectional view taken along line I-I in FIG. 2.

Configuration of Double-Knitted Sock According to First Embodiment of the Present Invention The double-knitted sock 100 according to the first embodiment of the present invention is a sock having a two-layer structure that is hook-shaped in a side view as shown in FIG. 1, and mainly includes a foot covering portion 110, a heel covering portion 120, an Achilles tendon covering portion 130, an ankle covering portion 140, a lower leg covering portion 150, and a sock opening portion 160 as shown in FIGS. 1 and 2. Further, as shown in FIG. 3, the double-knitted sock 100 can be said to be constituted by an inner layer IL and an outer layer OL. These constituent parts and the two-layer structure will be described in detail below.

For convenience of description, an top-bottom direction, a right-left direction, and a front-rear direction are defined in FIGS. 1 to 3. Hereinafter, the configuration of the double-knitted sock 100 may be described using these directions.

The lower leg covering portion 150 and the sock opening portion 160 may not be provided in the double-knitted sock 100. In a case where only the lower leg covering portion 150 is not provided, the sock opening portion 160 is provided on the Achilles tendon covering portion 130 and the ankle covering portion 140. When the multi-knitted wearable garment is a stocking or tights, a thigh covering portion is provided instead of the sock opening portion 160, and a panty portion or the like is added to the upper side of the thigh covering portion. Note that the thigh portion is a portion from the knee to the crotch, and the panty portion is a portion covering a part or the whole of the region from the crotch to the waist.

(1) Foot Covering Portion

The foot covering portion 110 is a bag-shaped portion for covering a portion from the ankle to the toe, and mainly includes an instep-side covering portion 111 and a bottom-side covering portion 112, as shown in FIG. 1. These portions will be described in detail below.

(1-1) Instep-side Covering Portion

The instep-side covering portion 111 is a portion that mainly covers the instep side of the shoe, and is constituted by an instep-side base portion 111*b* and an instep-side tip portion 111*t* as shown in FIG. 1. The instep-side base portion 111*b* is a substantially rectangular portion mainly for covering the instep. The instep-side base portion 111*b* forms a tubular main covering portion BP together with the bottom-side base portion 112*b* (see FIG. 1). The instep-side tip portion 111*t* is a substantially semi-disc-shaped portion for mainly covering the nail side of the toe, and extends forward from the tip of the instep-side base portion 111*b*. The instep-side tip portion 111*t* forms a bag-shaped tip covering portion TP together with the bottom-side tip portion 112*t* of the bottom-side covering portion 112 (see FIG. 1).

The inner layer portion I11 (see FIG. 3) of the instep-side covering portion 111 is knitted by plain knitting, mesh knitting, tuck knitting, or the like. The inner layer portion I11 may or may not have air permeability. The yarn constituting the knitted fabric for knitting the inner layer portion I11 may be yarn having water-absorbing and quick-drying properties (hereinafter referred to as "water-absorbing and quick-drying yarn"). Examples of the water-absorbing and quick-drying yarn include polyester/polyurethane composite yarn such as LYCRA (registered trade mark) fr. FX30/75. Note that LYCRA (registered trade mark) fr. FX30/75 also has deodorizing properties. Further, as the yarn constituting the knitted fabric for knitting the inner layer portion I11, yarn other than the water-absorbing and quick-drying yarn may be used in combination. Examples of yarn other than the water-absorbing and quick-drying yarn include yarn having moisture-absorbing and heat-generating properties (hereinafter referred to as "moisture-absorbing and heat-generating yarn"), yarn having moisture-absorbing and moisture-releasing properties (hereinafter referred to as "moisture absorbing and releasing yarn"), yarn having deodorant properties (hereinafter referred as "deodorant yarn"), and the like. Examples of the moisture-absorbent heat-generating yarn include polyester/rayon-based mixed yarn such as High Heat-T, and acrylic/rayon-based mixed yarn such as WARM PLUS-R. Note that the acrylic/rayon mixed yarn usually shows a temperature rise (moisture-absorbent and heat-generating properties) of 3.7° C. in the moisture-absorbent heat-generating B method (test room temperature: 20±2° C., initial humidity: 40% RH, humidity during humidification: 90% RH). Further, a double-structure knitted fabric including a plain stitch knitted from acrylic/rayon mixed yarn and an all-pile stitch shows a heat retention rate of 47.2% in a heat retention test using a Thermolabo II tester (environmental conditions: 20° C., 65% RH); a double-structure knitted fabric including the plain stitch and a border-pile stitch shows a heat retention rate of 46.8% in the same heat retention test. Conversely, yarn used to knit the fabrics of other companies' products show only a temperature increase of at most 3.3° C. under the same conditions. In addition, the bulky knitted fabrics of other companies only show the same or lower heat retention rate in the same heat retention test. Examples of the moisture absorbing and releasing yarn include cotton yarn, wool yarn, polyester yarn, and acrylic yarn. When the inner layer portion I11 is knitted with the water-absorbing and quick-drying yarn and yarn other than the water-absorbing and quick-drying yarn, one yarn may be the front yarn and the other yarn may be the back yarn. In such a case, it is preferable that water-absorbing and quick-drying yarn is adopted as the back yarn, and yarn other than the water-absorbing and quick-drying yarn (for example, moisture-absorbent and heat-generating yarn, moisture absorbing and releasing yarn, deodorant yarn, or the like) is adopted as the front yarn.

Figure 4:
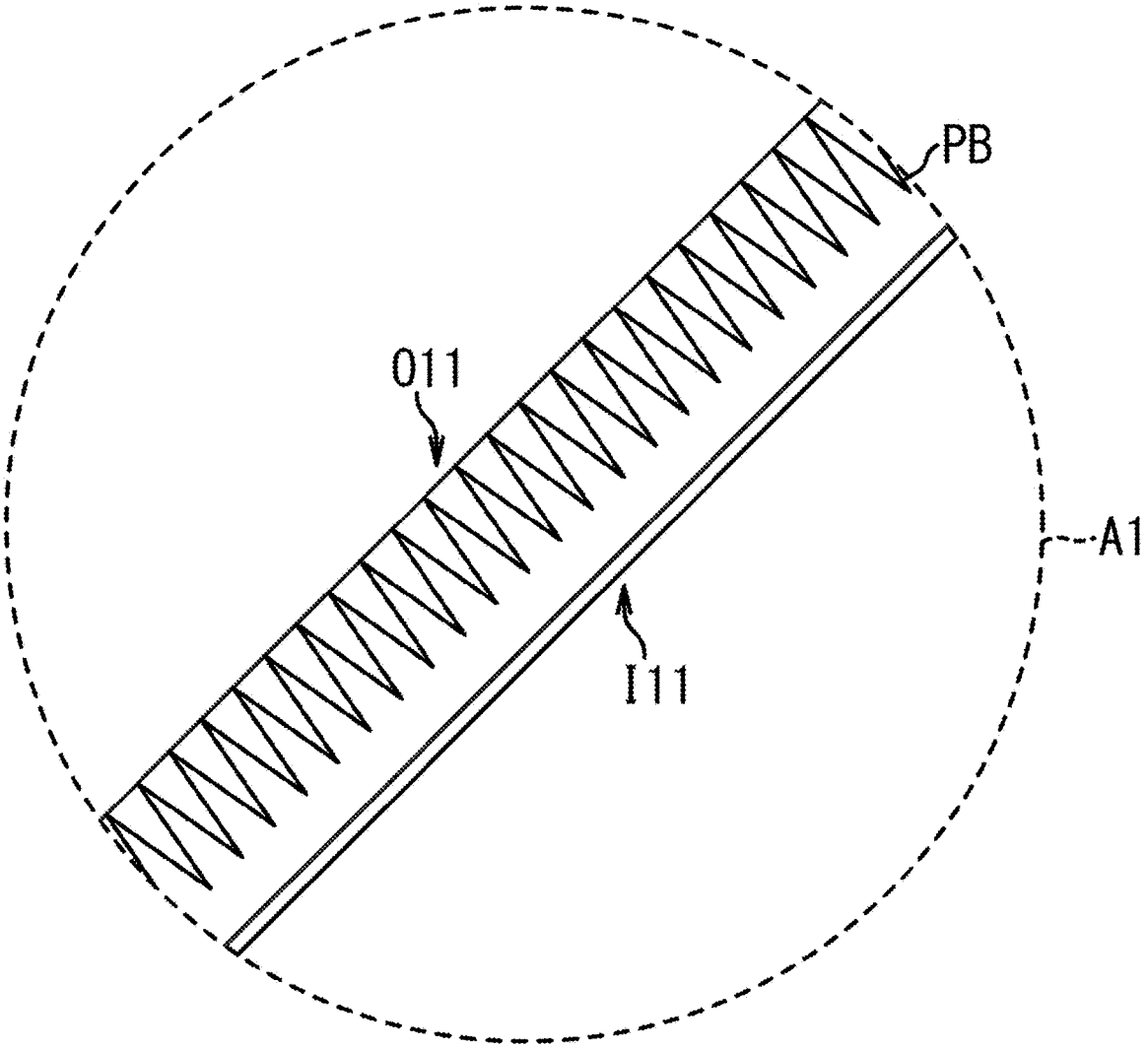
FIG. 4 is an enlarged view of an A1 portion of FIG. 3.

In contrast, the outer layer portion O11 of the instep-side covering portion 111 is knitted by full-face bulky knitting such as full-face pile knitting. The bulky knitting not only forms an air layer that holds (contains) more air than plain knitting, mesh knitting, tuck knitting, or the like, but also provides cushioning properties when a wearer walks, or the like. In other words, the bulky knitting has higher heat retention properties than the inner layer portion I11 or a lower heat conductivity than the water-absorbing and quick-drying knitted fabric. The bulky knitting may have an air layer and high cushioning properties, and the material and the manufacturing method thereof should not particularly be limited. The bulky knitting can be formed by, for example, (i) a method of changing the shape of stitches such as pile knitting or pseudo-pile knitting in which stitches are formed in a loop shape, (ii) a method of using bulky (fluffy) yarn such as bulky yarn subjected to bulky finish or non-twisted yarn, (iii) a method of performing post-treatment such as raising the fabric after forming the entire outer layer portion O11 of the instep-side covering portion 111, or (iv) a method of attaching a separate member, which is achieved by attaching a sponge-like member such as urethane foam (see, for example, Japanese Patent Application Laid-Open No. 2021-116509). As shown in FIG. 4, the outer layer portion O11 is knitted such that the bulky portion PB (for example, a pile portion) faces the inner layer side.

(1-2) Bottom-Side Covering Portion

The bottom-side covering portion 112 is a portion that mainly covers the bottom side of the foot, and is composed of a bottom-side base portion 112*b* and a bottom-side tip portion 112*t* as shown in FIG. 1. The bottom-side base portion 112*b* is a substantially rectangular portion mainly for covering the bottom of the foot. The bottom-side base portion 112*b* forms a tubular main covering portion BP together with the instep-side base portion 111*b* (see FIG. 1). The bottom-side tip portion 112*t* is a substantially semi-disc-shaped portion for mainly covering the ball side of the toe, and extends forward from the tip of the bottom-side base portion 112*b*. The bottom-side tip portion 112*t* forms a bag-shaped tip covering portion TP together with the instep-side tip portion 111*t* of the instep-side covering portion 111 (see FIG. 1).

The inner layer portion I12 of the bottom-side covering portion 112 may be knitted by plain knitting, mesh knitting, tuck knitting, or the like similarly to the inner layer portion I11 of the instep-side covering portion 111, or may be knitted with other knitted fabrics. The inner layer portion I12 may be knitted with the same yarn as the yarn constituting the inner layer portion I11 of the instep-side covering portion 111, or may be knitted with yarn different from the yarn constituting the inner layer portion I11 of the instep-side covering portion 111. However, it is preferable that the water-absorbing and quick-drying yarn is included as the yarn for knitting the inner layer portion I12 of the bottom-side covering portion 112.

Figure 5:
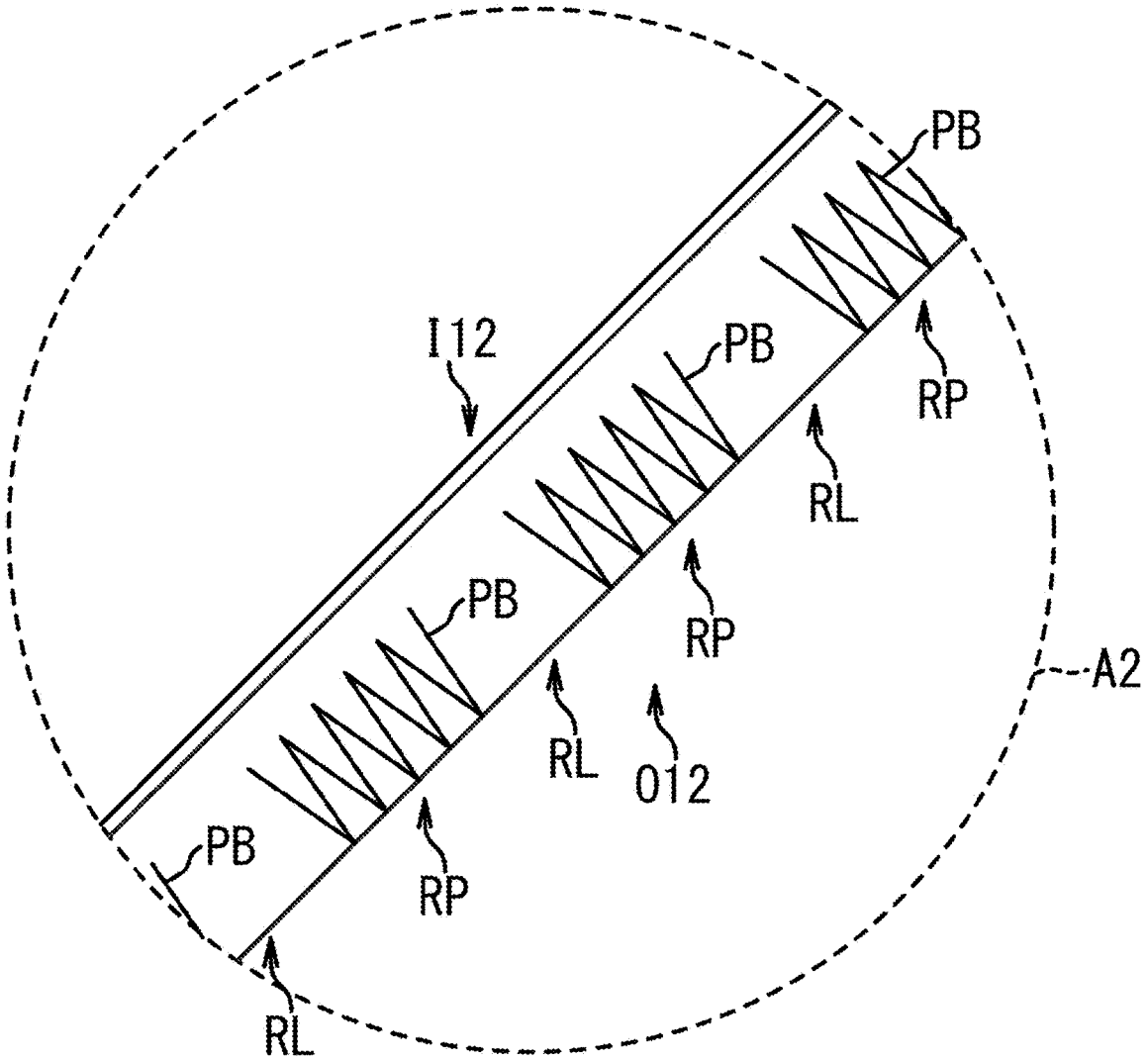
FIG. 5 is an enlarged view of an A2 portion of FIG. 3.
Figure 6:
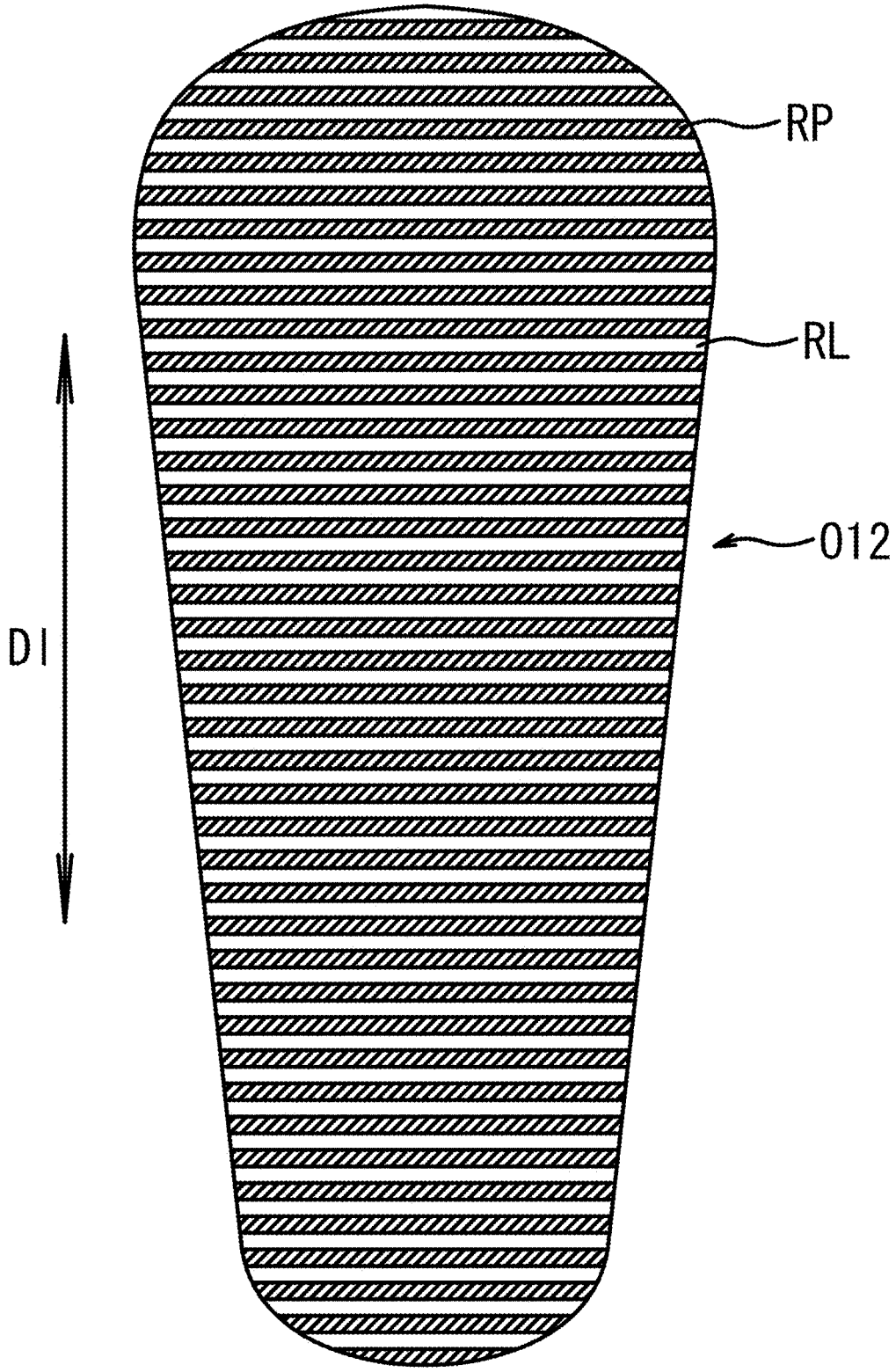
FIG. 6 is a plan view of an outer layer portion of a bottom-side covering portion of a foot covering portion in the double-knitted sock according to the first embodiment of the present invention.

Conversely, the outer layer portion O12 of the bottom-side covering portion 112 is knitted by partial bulky knitting such as border pile knitting. As shown in FIG. 6, the outer layer portion O12 is knitted such that straight banded bulky regions RP and straight banded low-bulk regions RL are alternately arranged along the longitudinal direction DI. The bulky region RP can be produced by the above-described method for producing a bulky knitted fabric. Conversely, the low-bulk region RL is a region having a lower bulk than the bulky region, and can be knitted by, for example, plain knitting, mesh knitting, tuck knitting, or the like, or a combination thereof. Such partial bulky knitting can be performed by alternately repeating bulky knitting and low-bulk knitting in the wale direction (see, for example, Japanese Utility Model Registration No. 3121397). In such a case, it is preferable to use thick yarn in the bulky knitting and use thin yarn in the low-bulk knitting. As shown in FIG. 5, the outer layer portion O12 is knitted such that the bulky portion PB (for example, a pile portion) faces the inner layer side.

(2) Heel Covering Portion

The heel covering portion 120 is a portion for covering the heel, and extends rearward from the rear end of the foot covering portion 110 as shown in FIG. 1.

The inner layer portion I20 (see FIG. 3) of the heel covering portion 120 may be knitted by plain knitting, mesh knitting, tuck knitting, or the like similarly to the inner layer portion I11 of the instep-side covering portion 111: or it may be knitted with other knitted fabrics. The inner layer portion I20 may be knitted with the same yarn as the yarn constituting the inner layer portion I11 of the instep-side covering portion 111, or may be knitted with yarn different from the yarn constituting the inner layer portion I11 of the instep-side covering portion 111.

Conversely, the outer layer portion O20 of the heel covering portion 120 may be knitted by bulky knitting such as pile knitting, similarly to the outer layer portion O11 of the instep-side covering part 111, or may be knitted with other knitted fabrics. When the outer layer portion O20 of the heel covering portion 120 is knitted by the bulky knitting, the bulky knitting may be performed by the same method as the knitting method of the outer layer portion O11 of the instep-side covering portion 111, or the bulky knitting may be performed by a method different from the knitting method of the outer layer portion O11 of the instep-side covering portion 111.

(3) Achilles Tendon Covering Portion

The Achilles tendon covering portion 130 is a portion for covering the portion of the Achilles tendon, and extends upward from the upper end of the rear side of the heel covering portion 120 as shown in FIGS. 1 and 2.

The inner layer portion I30 of the Achilles tendon covering portion 130 may be knitted by plain knitting, mesh knitting, tuck knitting, or the like similarly to the inner layer portion I11 of the instep-side covering portion 111: or it may be knitted with other knitted fabrics. The inner layer portion I30 may be knitted with the same yarn as the yarn constituting the inner layer portion I11 of the instep-side covering portion 111, or may be knitted with yarn different from the yarn constituting the inner layer portion I11 of the instep-side covering portion 111.

Conversely, the outer layer portion O30 of the Achilles tendon covering portion 130 may be knitted by bulky knitting such as pile knitting, similarly to the outer layer portion O11 of the instep-side covering portion 111, or may be knitted with other knitted fabrics. When the outer layer portion O30 of the Achilles tendon covering portion 130 is knitted by the bulky knitting, the bulky knitting may be knitted by the same method as the knitting method of the outer layer portion O11 of the instep-side covering portion 111, or the bulky knitting may be knitted by a method different from the knitting method of the outer layer portion O11 of the instep-side covering portion 111.

(4) Ankle Covering Portion

The ankle covering portion 140 is a portion for covering the ankle, and extends upward from the front upper end of the foot covering portion 110 as shown in FIG. 1. The ankle covering portion 140 is located below the lower leg covering portion 150.

The inner layer portion I40 of the ankle covering portion 140 may be knitted by plain knitting, mesh knitting, tuck knitting, or the like similar to the inner layer portion I11 of the instep-side covering portion 111: or it may be knitted with other knitted fabrics. The inner layer portion 140 may be knitted with the same yarn as the yarn constituting the inner layer portion I11 of the instep-side covering portion 111, or may be knitted with yarn different from the yarn constituting the inner layer portion I11 of the instep-side covering portion 111.

Conversely, the outer layer portion O40 of the ankle covering portion 140 may be knitted by bulky knitting such as pile knitting, similarly to the outer layer portion O11 of the instep-side covering portion 111, or may be knitted with other knitted fabrics. When the outer layer portion O40 of the ankle covering portion 140 is knitted by the bulky knitting, the bulky knitting may be performed by the same method as the knitting method of the outer layer portion O11 of the instep-side covering portion 111: or the bulky knitting may be performed by a method different from the knitting method of the outer layer portion O11 of the instep-side covering portion 111.

(5) Lower Leg Covering Portion

The lower leg covering portion 150 is a tubular portion for covering the lower leg portion, and as shown in FIGS. 1 and 2, extends upward from the upper ends of the Achilles tendon covering portion 130 and the ankle covering portion 140. The lower leg covering portion 150 is preferably formed in a tapered shape in which the width gradually increases from the ankle covering portion side toward the sock opening side.

The inner layer portion I50 of the lower leg covering portion 150 may be knitted by plain knitting, mesh knitting, tuck knitting, or the like, similarly to the inner layer portion I11 of the instep-side covering portion 111: or it may be knitted with other knitted fabrics. The inner layer portion 150 may be knitted with the same yarn as the yarn constituting the inner layer portion I11 of the instep-side covering portion 111, or may be knitted with yarn different from the yarn constituting the inner layer portion I11 of the instep-side covering portion 111.

Conversely, the outer layer portion O50 of the lower leg covering portion 150 may be knitted by bulky knitting such as pile knitting, similarly to the outer layer portion O11 of the instep-side covering portion 111, or may be knitted with other knitted fabrics. When the outer layer portion O50 of the lower leg covering portion 150 is knitted by the bulky knitting, the bulky knitting may be performed by the same method as the knitting method of the outer layer portion O11 of the instep-side covering portion 111: or the bulky knitting may be performed by a method different from the knitting method of the outer layer portion O11 of the instep-side covering portion 111.

(6) Sock Opening Portion

The sock opening portion 160 is a portion formed for the purpose of making the double-knitted sock 100 easy to wear and making the double-knitted sock 100 less likely to slip off, and is formed on the upper side of the lower leg covering portion 150 as shown in FIGS. 1 and 2.

The inner layer portion I60 of the sock opening portion 160 may be knitted by plain knitting, mesh knitting, tuck knitting, or the like, similar to the inner layer portion I11 of the instep-side covering portion 111; or it may be knitted with other knitted fabrics. The inner layer portion 160 may be knitted with the same yarn as the yarn constituting the inner layer portion I11 of the instep-side covering portion 111, or may be knitted with yarn different from the yarn constituting the inner layer portion I11 of the instep-side covering portion 111.

Conversely, the outer layer portion O60 of the sock opening portion 160 may be knitted by bulky knitting such as pile knitting, similarly to the outer layer portion O11 of the instep-side covering portion 111, or may be knitted with other knitted fabrics. When the outer layer portion O60 of the sock opening portion 160 is knitted by the bulky knitting, the bulky knitting may be performed by the same method as the knitting method of the outer layer portion O11 of the instep-side covering portion 111: or the bulky knitting may be performed by a method different from the knitting method of the outer layer portion O11 of the instep-side covering portion 111. The outer layer portion O60 of the sock opening portion 160 may be knitted with a stretchable knitted fabric. The knitted fabric having high stretchability can be knitted with, for example, natural yarn such as cotton, hemp, wool, and silk, synthetic yarn such as nylon and polyester, or blended yarn thereof.

Specific Method for Forming Double-Knitted Sock According to First Embodiment of the Present Invention The double-knitted sock 100 can be formed in various ways, but is preferably formed by knitting a knitted fabric.

Examples of Such Methods Include (i) a method of knitting the outer layer OL by knitting from the sock opening side to the tip covering portion TP of the foot covering portion 110, then knitting the inner layer IL by knitting from the tip side of the foot covering portion 110 to the sock opening portion 160, then pushing the inner layer IL into the outer layer OL, and then sewing the inner layer I60 and the outer layer O60 of the sock opening portion 160 with connecting yarn, (ii) a method of knitting the inner layer IL by knitting from the sock opening side to the tip covering portion TP of the foot covering portion 110, then knitting the outer layer OL by knitting from the tip side of the foot covering portion 110 to the sock opening portion 160, then pushing the inner layer IL into the outer layer OL, and then sewing the inner layer I60 and the outer layer O60 of the sock opening portion 160 with connecting yarn, (iii) a method of knitting the outer layer OL by knitting from the tip covering portion of the foot covering portion 110 to the sock opening portion 160, then knitting the inner layer IL by knitting from the sock opening side to the tip covering portion TP of the foot covering portion 110, then pushing the inner layer IL into the outer layer OL, and then sewing the inner and outer layer portions of the tip covering portion TP of the foot covering portion 110 with connecting yarn (see, for example, Japanese Patent Application Laid-Open No. 2004-36059 or Japanese Utility Model Registration No. 3055454), (iv) a method of knitting the inner layer IL by knitting from the tip covering portion of the foot covering portion 110 to the sock opening portion 160, then knitting the outer layer OL by knitting from the sock opening side to the tip covering portion TP of the foot covering portion 110, then pushing the inner layer IL into the outer layer OL, and then sewing the inner and outer layer portions of the tip covering portion TP of the foot covering portion 110 with connecting yarn (see, for example, Japanese Patent Application Laid-Open No. 2004-36059 or Japanese Utility Model Registration No. 3055454), (v) a method of knitting the inner layer IL and outer layer OL separately, then pressing the inner layer IL into the interior of the outer layer OL, and then sewing the inner and outer layer portions of the tip covering portion TP of the foot covering portion 110 with connecting yarn and further sewing the inner layer portion I60 and outer layer portion O60 of the sock opening portion 160 with connecting yarn, and (vi) a method of knitting the inner layer IL and outer layer OL separately, then pressing the inner layer IL into the interior of the outer layer OL, and then fastening the inner layer portion 160 and the outer layer portion O60 of the sock opening portion 160 with hooks, buttons, or the like in an attachable and detachable manner.

Characteristics of Double-Knitted Sock According to First Embodiment of the Present Invention The double-knitted sock 100 according to the first embodiment of the present invention has the above-described configuration, and thus has excellent heat retention properties and excellent water-absorbing and quick-drying properties. Thus, the double-knitted sock 100 has excellent heat retention properties, and the foot of a person wearing the double-knitted sock 100 on the foot is less likely to get stuffy.

In the double-knitted sock 100, the outer layer portion O12 of the bottom-side covering portion 112 of the foot covering portion 110 is knitted by partial bulk knitting. This causes the air above the low bulk region RL to flow and diffuse due to the air flow and diffusion action of the bulky region RP every time the wearer steps on the bottom-side covering portion 112. Thus, the double-knitted sock 100 allows air warmed in the sock to flow and diffuse during walking or the like, thereby warming a relatively wide foot region. In addition, such air flow and diffusion action encourages the humid air inside the system to be gradually discharged to the outside of the system, thus preventing the foot of the wearer from becoming stuffy.

Modification (A)

In the double-knitted sock 100 according to the first embodiment, the bag-shaped tip covering portion TP is formed with the instep-side tip portion 111*t* and the bottom-side tip portion 112*t*; however, a toe bag portion for covering each or several toes of the foot may be formed with the instep-side tip portion and the bottom-side tip portion.

(B)

In the first embodiment, the double-knitted sock 100 is taken as an example of the multi-knitted wearable garment; however, the multi-knitted wearable garment should not be limited to the double-knitted sock 100, and may be a multi-knitted sock with three or more layers.

(C)

In the double-knitted sock 100 according to the first embodiment, the outer layer portion O12 of the bottom-side covering portion 112 is knitted by partial bulky knitting such as border pile knitting; however, the outer layer portion O12 of the bottom-side covering portion 112 may be knitted by full bulky knitting such as full pile knitting.

(D)

In the double-knitted sock 100 according to the first embodiment, the outer layer portion O11 of the instep-side covering portion 111 is knitted by full-face bulk knitting such as full-face pile knitting: however, the outer layer portion O11 of the instep-side covering portion 111 may be knitted by partial bulk knitting such as border pile knitting.

(E)

In the double-knitted sock 100 according to the first embodiment, the inner layer portion I11 (see FIG. 3) of the instep-side covering portion 111 is knitted by plain knitting, mesh knitting, tuck knitting, or the like, and the outer layer portion O11 of the instep-side covering portion 111 is knitted by full-face bulk knitting such as full-face pile knitting. However, the outer layer portion O11 of the instep-side covering portion 111 may be knitted by plain knitting, mesh knitting, tuck knitting, or the like, and the inner layer portion I11 (see FIG. 3) of the instep-side covering portion 111 may be knitted by full-face bulk knitting such as full-face pile knitting. In this case, it is preferable that the bulky portion PB (e.g., pile portion) of the inner layer portion I11 of the instep-side covering portion 111 is knitted so as to face the outer layer side.

(F)

In the double-knitted sock 100 according to the first embodiment, the inner layer portion 112 of the bottom-side covering portion 112 is knitted by plain knitting, mesh knitting, tuck knitting, or the like, and the outer layer portion O12 of the bottom-side covering portion 112 is knitted by partial bulk knitting such as border-pile knitting. However, the inner layer portion 112 of the bottom-side covering portion 112 may be knitted by partial bulk knitting such as border-pile knitting, and the outer layer portion O12 of the bottom-side covering portion 112 may be knitted by plain knitting, mesh knitting, tuck knitting, or the like. In this case, it is preferable that the bulky region RP (for example, the pile portion) of the inner layer portion 112 of the bottom-side covering portion 112 is knitted so as to face the outer layer side.

(G)

In the double-knitted sock 100 according to the first embodiment, the entire inner layer portion I11 of the instep-side covering portion 111 of the foot covering portion 110 is knitted by plain knitting, mesh knitting, tuck knitting, or the like; however, a part of the inner layer portion I11 may be knitted by plain knitting, mesh knitting, tuck knitting, or the like, and the other part may be knitted by a knitted fabric different from the part.

(H)

In the double-knitted sock 100 according to the first embodiment, the entire outer layer portion O11 of the instep-side covering portion 111 of the foot covering portion 110 is knitted by full-face bulk knitting; however, a part of the outer layer portion O11 may be knitted by full-face bulk knitting and the other part may be knitted by a knitted fabric different from the part.

(I)

In the double-knitted sock 100 according to the first embodiment, the entire inner layer portion I12 of the bottom-side covering portion 112 of the foot covering portion 110 is knitted by plain knitting, mesh knitting, tuck knitting, or the like; however, a part of the inner layer portion I12 may be knitted by plain knitting, mesh knitting, tuck knitting, or the like, and the other part may be knitted by a knitted fabric different from the part.

(J)

In the double-knitted sock 100 according to the first embodiment, the entire outer layer portion O12 of the bottom-side covering portion 112 of the foot covering portion 110 is knitted by partial bulk knitting; however, a part of the outer layer portion O12 may be knitted by partial bulk knitting, and the other part may be knitted by a knitted fabric different from the part.

(K)

In the double-knitted sock 100 of the first embodiment, the inner layer I11 of the instep-side covering portion 111 of the foot covering portion 110 may be knitted with the water-absorbing and quick-drying yarn or the water-absorbing and quick-drying yarn and the yarn other than the water-absorbing and quick-drying yarn (e.g., moisture-absorbent and heat-generating yarn, moisture-absorbing and releasing yarn, deodorant yarn). When the inner layer I12 of the bottom-side covering portion 112 is knitted with such yarn, the inner layer I11 of the instep-side covering portion 111 may be knitted with only the moisture-absorbent and heat-generating yarn, moisture-absorbing and releasing yarn, or deodorant yarn.

(L)

Figure 7:
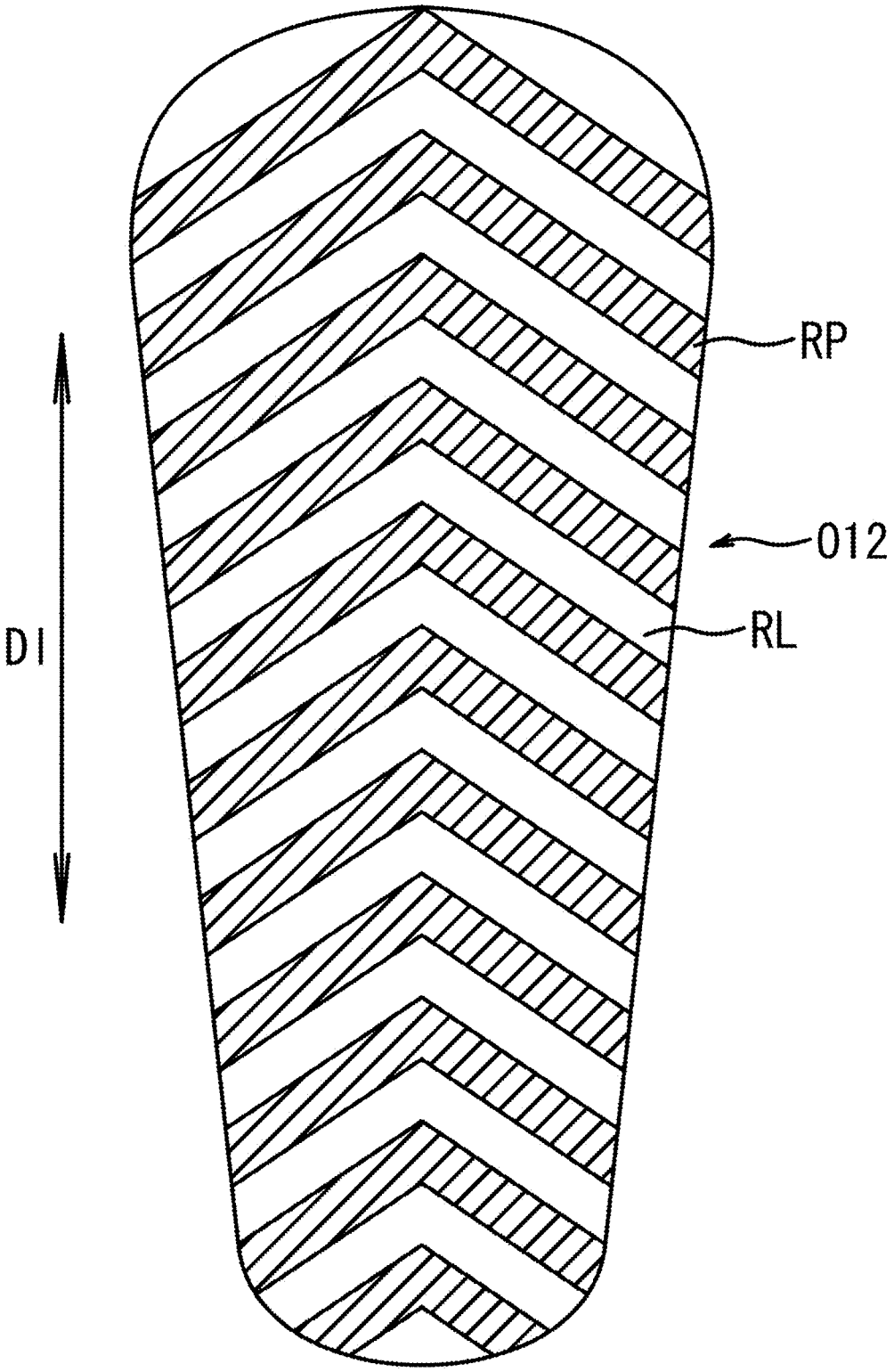
FIG. 7 is a plan view of the outer layer portion of the bottom-side covering portion of the foot covering portion in the double-knitted sock according to a modification (L) of the first embodiment.
Figure 8:
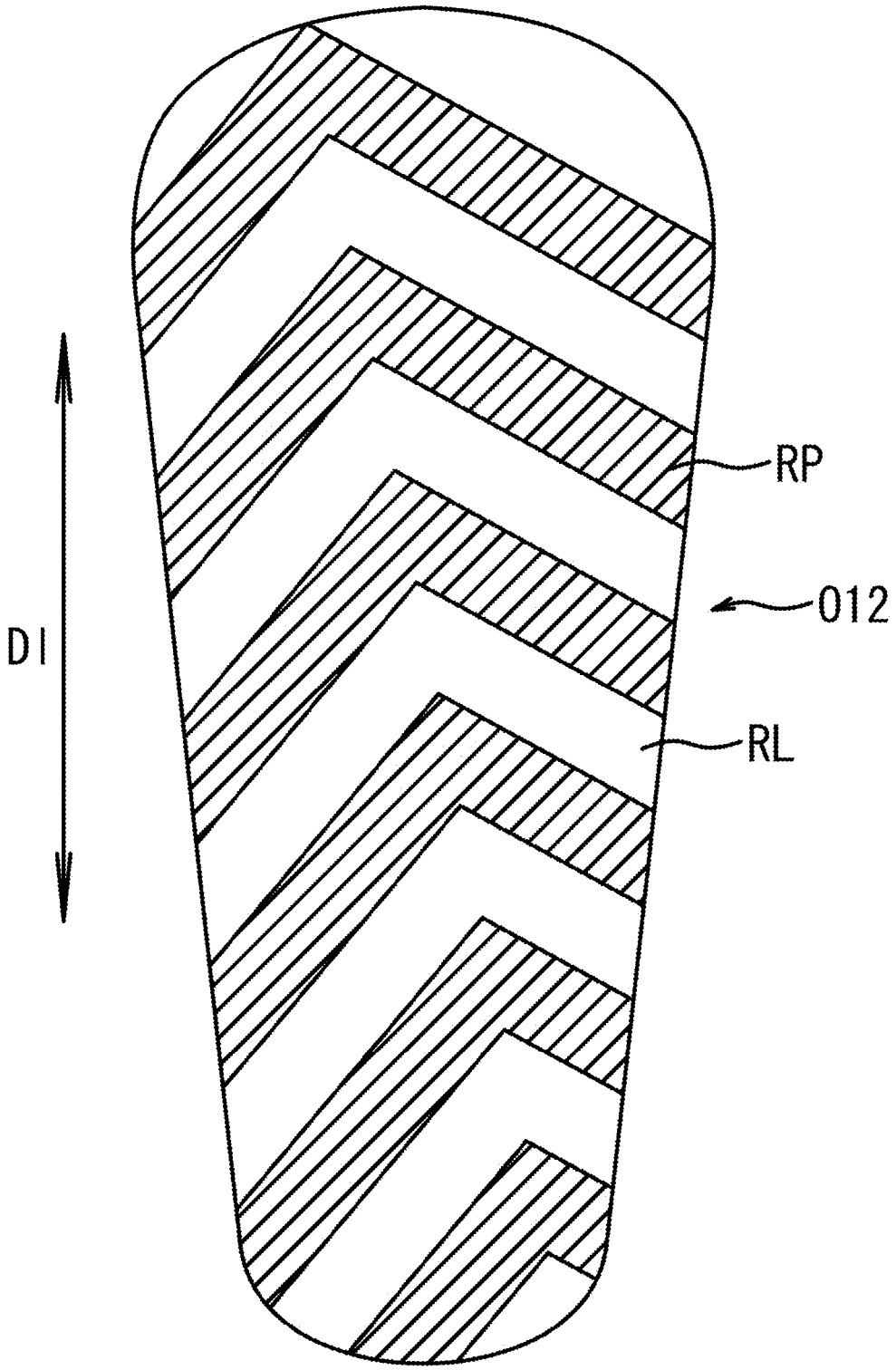
FIG. 8 is a plan view of the outer layer portion of the bottom-side covering portion of the foot covering portion in the double-knitted sock according to the modification (L) of the first embodiment.

In the double-knitted sock 100 according to the first embodiment, the outer layer portion O12 of the bottom-side covering portion 112 of the foot covering portion 110 is knitted such that the straight banded bulky regions RP and the straight banded low-bulk regions RL are alternately arranged along the longitudinal direction Dl: however, as shown in FIG. 7, it may be knitted so that the triangular-roof-like banded bulky regions RP and the triangular-roof-like banded bulky regions RL are alternately arranged along the length direction Dl of the leg: alternatively, as shown in FIG. 8, it may be knitted so that the triangular-roof-like banded bulky region RP and the triangular-roof-like banded bulky region RL are alternately arranged along the direction that intersects the foot length direction DI.

(M)

Figure 9:
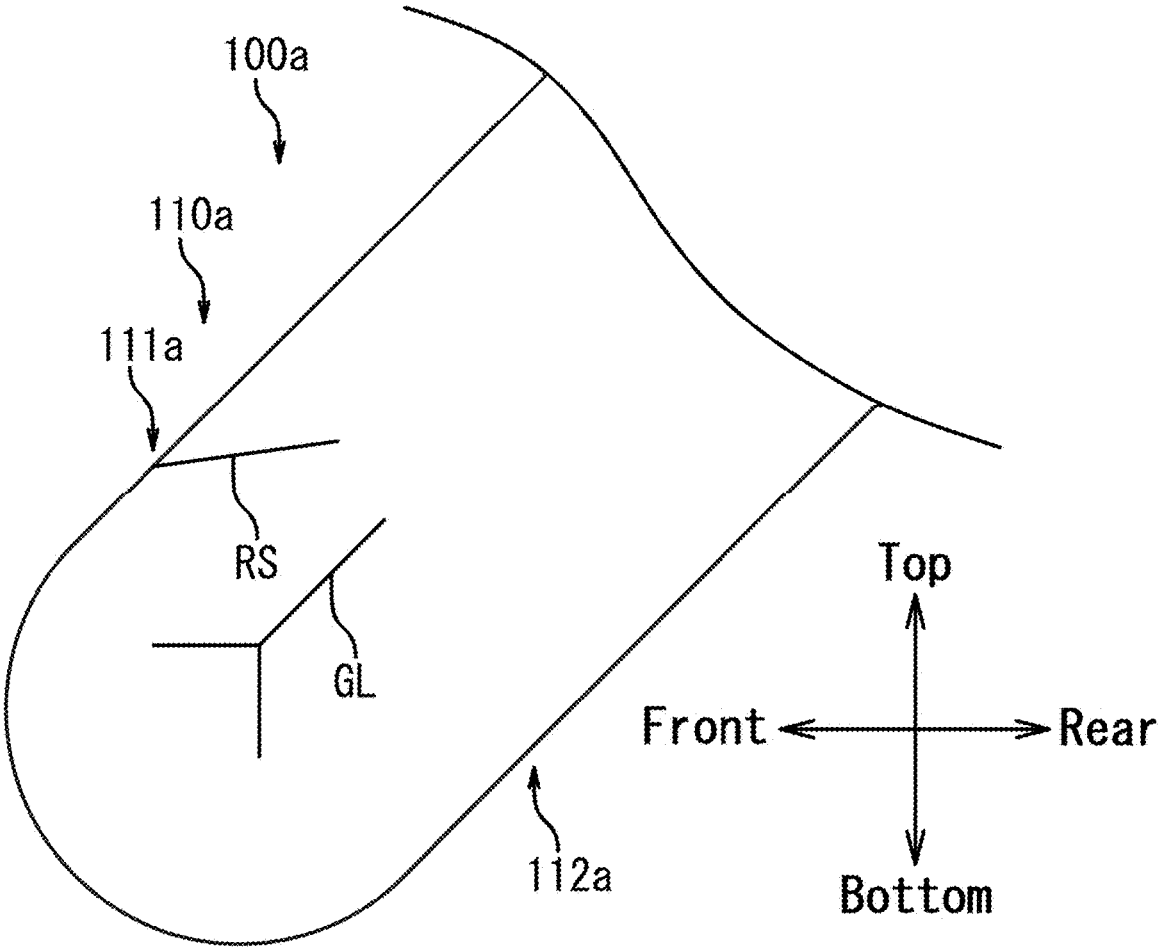
FIG. 9 is a view showing a gore line and a rosso in the foot covering portion of the double-knitted sock according to the first embodiment of the present invention.

The double-knitted sock 100 according to the first embodiment has a two-layer structure as a whole, but only the tip portion of the foot covering portion of the sock may have a two-layer structure. In such a case, a portion other than the tip portion may have a single-layer structure, and the portion may be knitted into any knitted fabric (for example, plain knitting, mesh knitting, tuck knitting, full-pile knitting, border pile knitting, or the like). In this case, as shown in FIG. 9, bifurcating the gore line GL at the tip portion into a Y-shape (in this case, the lower bar portion of "Y" passes through the substantially center of the height direction of the foot covering portion, and the head portion of "Y" faces the tip end) causes the tip portion to be greatly knitted, thereby allowing for moving the position of the sewing portion RS for an overlock sewing machine or a Rosso from the tip side to the instep side when the overlock sewing machine or the Rosso is used in the forward stitch (in other words, the position of the sewing portion RS can be moved to a portion (a portion of one layer) other than the tip portion as much as possible). In this way, such a sock can reduce the tightness when the wearer wears the shoe, and can reduce the discomfort and pain due to the presence of the stitched portion RS.

(N)

Although not particularly mentioned in the first embodiment, a knitted fabric knitted with hollow yarn (yarn having a hollow cross section) or a partial knitted fabric knitted with hollow yarn may be employed instead of the bulky knitting or the partial bulky knitting. In this case, the technical effect described in the first embodiment can be achieved.

The above-described modifications may be employed alone or in combination as appropriate as long as there is no contradiction.

Second Embodiment

Figure 10:
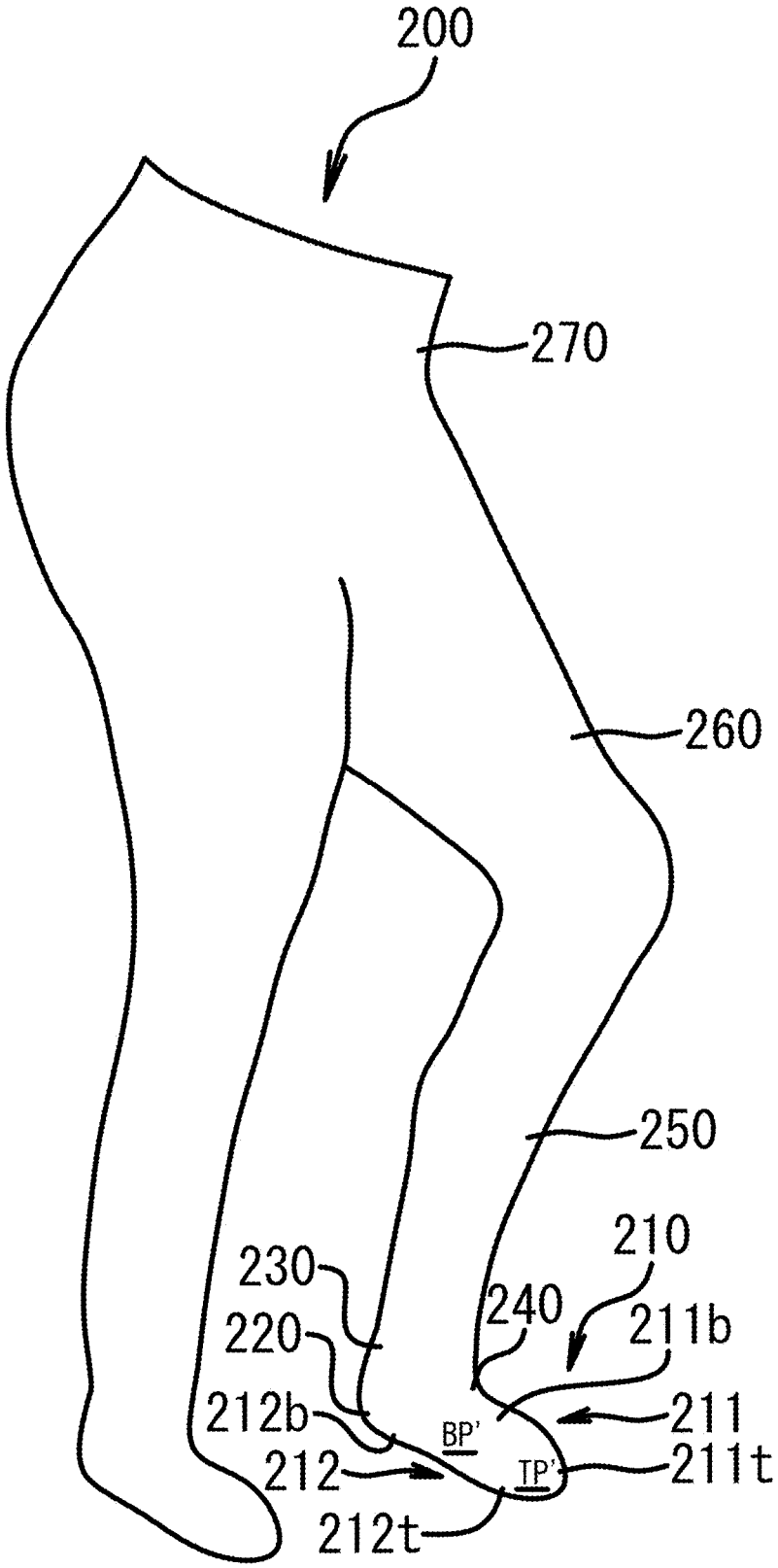
FIG. 10 is a perspective view of the double-knitted tights according to a second embodiment of the present invention when worn.
Figures 11, 12:
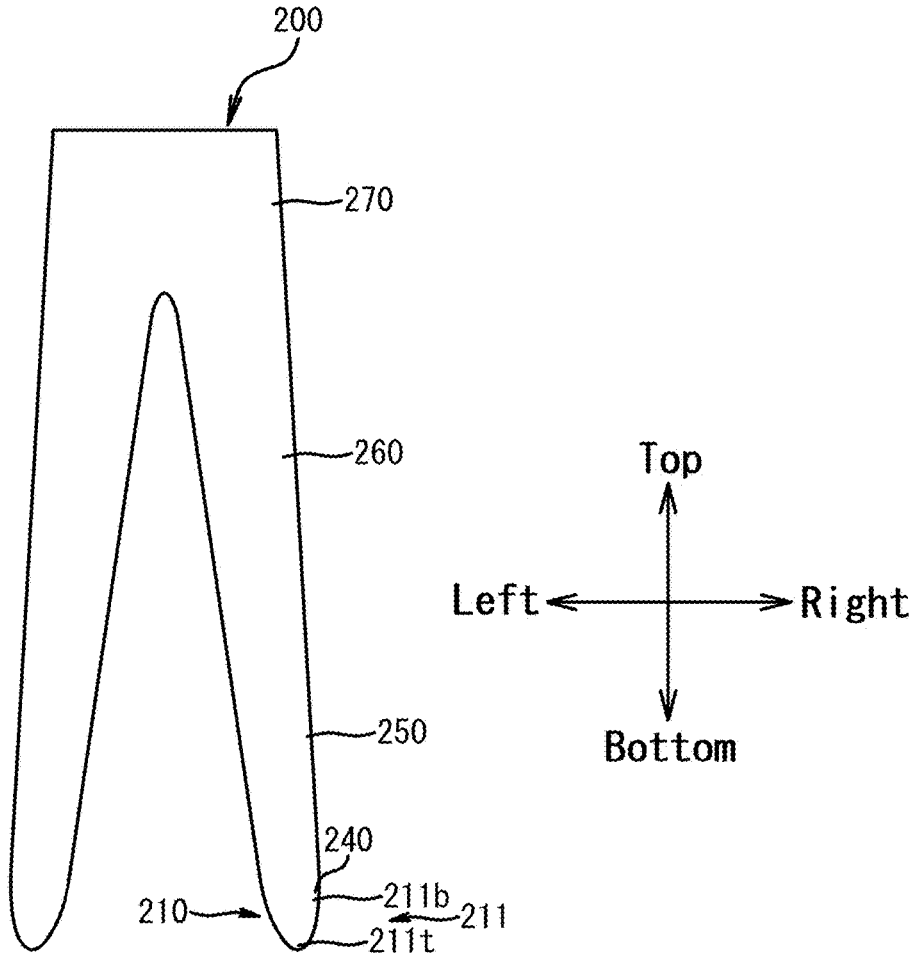
FIG. 11 is a plan view of a double-knitted tights according to the second embodiment of the present invention.
FIG. 12 is a knitting diagram of a pseudo pile knitted fabric constituting an outer layer portion of a instep-side covering portion and the like in the double-knitted tights according to the second embodiment of the present invention.

Configuration of Double-Knitted Tights According to Second Embodiment of the Present Invention As shown in FIGS. 10 and 11, double-knitted tights 200 according to a second embodiment of the present invention mainly includes a foot covering portion 210, a heel covering portion 220, an Achilles tendon covering portion 230, an ankle covering portion 240, a lower leg covering portion 250, a thigh covering portion 260, and a panty portion 270. It can also be said that the double-knitted tights 200 are constituted by an inner layer and an outer layer, as in the double-knitted sock 100 according to the first embodiment. These constituent parts and the two-layer structure will be described in detail below.

For convenience of description, a top-bottom direction and a right-left direction are defined in FIG. 11. A direction orthogonal to both the top-bottom direction and the right-left direction is a front-rear direction. Hereinafter, the configuration of the double-knitted tights 200 may be described using these directions.

(1) Foot Covering Portion

The foot covering portion 210 is a bag-shaped portion for covering a portion from the ankle to the toe, and mainly includes a instep-side covering portion 211 and a bottom-side covering portion 212, as shown in FIG. 11. These portions will be described in detail below.

(1-1) Instep-side Covering Portion

The instep-side covering portion 211 is a portion that mainly covers the instep side of the foot, and is constituted by an instep-side base portion 211*b* and an instep-side tip portion 211*t* as shown in FIG. 10. The instep-side base portion 211*b* is a substantially rectangular portion mainly for covering the instep. The instep-side base portion 211*b* forms a tubular main covering portion BP' together with the bottom-side base portion 212*b* (see FIG. 10). The instep-side tip portion 211*t* is a substantially semi-disc-shaped portion for mainly covering the nail side of the toe, and extends forward from the tip of the instep-side base portion 211*b*. The instep-side tip portion 211*t* forms a bag-shaped tip covering portion TP' together with the bottom-side tip portion 212*t* of the bottom-side covering portion 212 (see FIG. 10).

The inner layer portion of the instep-side covering portion 211 is formed from an interwoven fabric (knitted fabric) of core-sheath yarn with elasticity and bulkiness (hereinafter, simply referred to as "core-sheath yarn" in some cases), in which sheath yarn covers core yarn, and water-absorbing and quick-drying yarn. Note that examples of the core-sheath yarn include single covered yarn (SCY) and double covered yarn (DCY). Examples of the single covered yarn mentioned here include yarn formed by winding nylon yarn as one sheath yarn around polyurethane elastic yarn as core yarn. In such a case, the denier number of the core yarn is preferably within a range from 20 to 40 inclusive, and the denier number of the sheath yarn is preferably within a range from 30 to 100 inclusive. Conversely, examples of the water-absorbing and quick-drying yarn include functional nylon yarn such as Wavelon (registered trademark) Ny, polyester yarn, and the like. Note that the inner layer portion may or may not have air permeability.

Conversely, the outer layer portion of the instep-side covering portion 211 is formed from an interwoven fabric (knitted fabric) of the core-sheath yarn described above and crimped yarn (hereinafter, simply referred to as a "crimped yarn" in some cases) having stretchability and bulkiness. The core-sheath yarn is as described above. In the above-described single covered yarn, the core yarn preferably has a denier number within a range from 20 to 40 inclusive, and the sheath yarn preferably has a denier number within a range from 30 to 100 inclusive. Examples of the crimped yarn include woolly nylon and conjugate yarn. The interwoven knitted fabric is preferably a pseudo pile knitted fabric (bulky knitted fabric) formed by interweaving a plain knitting course with the above-described core-sheath yarn and a tuck knitting course with the above-described crimped yarn. Examples of such a pseudo pile knitted fabric include a knitted fabric shown in the knitting diagram of FIG. 12.

(1-2) Bottom-Side Covering Portion

The bottom-side covering portion 212 is a portion that mainly covers the bottom side of the foot, and is constituted by a bottom-side base portion 212*b* and a bottom-side tip portion 212*t* as shown in FIG. 10. The bottom-side base portion 212*b* is a substantially rectangular portion for mainly covering the bottom of the foot. The bottom-side base portion 212*b* forms a tubular main covering portion BP' together with the instep-side base portion 211*b* (see FIG. 10). The bottom-side tip portion 212*t* is a substantially semi-disc-shaped portion for mainly covering the ball side of the toe, and extends forward from the tip of the bottom-side base portion 212*b*. The bottom-side tip portion 212*t* forms a bag-shaped tip covering portion TP' together with the instep-side tip portion 111*t* of the instep-side covering portion 211 (see FIG. 10)

The inner layer portion of the bottom-side covering portion 212 may be formed with the above-described interwoven fabric (knitted fabric) of the core-sheath yarn and the water-absorbing and quick-drying yarn similarly to the inner layer portion of the instep-side covering portion 211, or may be knitted of another knitted fabric. When the inner layer portion of the bottom-side covering portion 212 is formed with the interwoven fabric (knitted fabric), the interwoven fabric is preferably a pseudo pile knitted fabric (bulky knitted fabric) formed by interweaving a plain knitting course with the above-described core-sheath yarn and a tuck knitting course with the above-described crimped yarn. The inner layer portion may be knitted with the same yarn as the yarn constituting the inner layer portion of the instep-side covering portion 211, or may be knitted with yarn different from the yarn constituting the inner layer portion of the instep-side covering portion 211.

Conversely, the outer layer portion of the bottom-side covering portion 212 may be formed with an interwoven knitted fabric (knitted fabric) of the above-described core-sheath yarn and the above-described crimped yarn as in the outer layer portion of the instep-side cover portion 211, or may be knitted with another knitted fabric. The outer layer portion may be knitted with the same yarn as the yarn constituting the outer layer portion of the instep-side covering portion 211, or may be knitted with yarn different from the yarn constituting the outer layer portion of the instep-side covering portion 211.

(2) Heel Covering Portion

The heel covering portion 220 is a portion for covering the heel, and extends rearward from the rear end of the foot covering portion 210 as shown in FIG. 10.

The inner layer portion of the heel covering portion 220 may be formed with the interwoven fabric (knitted fabric) of the core-sheath yarn and the water-absorbing and quick-drying yarn described above, similarly to the inner layer portion of the instep-side covering portion 211, or may be knitted with another knitted fabric (for example, Zoki knitting or the like). The inner layer portion may be knitted with the same yarn as the yarn constituting the inner layer portion of the instep-side covering portion 211, or may be knitted with yarn different from the yarn constituting the inner layer portion.

Conversely, the outer layer portion of the heel covering portion 220 may be formed with an interwoven fabric (knitted fabric) of the above-described core-sheath yarn and the above-described crimped yarn similarly to the outer layer portion of the instep-side covering portion 211, or may be knitted with another knitted fabric (for example, Zoki knitting or the like). The outer layer portion may be knitted with the same yarn as the yarn constituting the outer layer portion of the instep-side covering portion 211, or may be knitted with yarn different from the yarn constituting the outer layer portion of the instep-side covering portion 211.

(3) Achilles Tendon Covering Portion

The Achilles tendon covering portion 230 is a portion for covering the portion of the Achilles tendon, and extends upward from the rear upper end of the heel covering portion 220 as shown in FIG. 10.

The inner layer portion of the Achilles tendon covering portion 230 may be formed with the interwoven fabric (knitted fabric) of the core-sheath yarn and the water-absorbing and quick-drying yarn described above, similarly to the inner layer portion of the instep-side covering portion 211, or may be knitted with another knitted fabric (for example, Zoki knitting or the like). The inner layer portion may be knitted with the same yarn as the yarn constituting the inner layer portion of the instep-side covering portion 211, or may be knitted with yarn different from the yarn constituting the inner layer portion.

Conversely, the outer layer portion of the Achilles tendon covering portion 230 may be formed with an interwoven fabric (knitted fabric) of the above-described core-sheath yarn and the above-described crimped yarn as in the outer layer portion of the instep-side covering portion 211, or may be knitted with another knitted fabric (for example, Zoki knitting or the like). The outer layer portion may be knitted with the same yarn as the yarn constituting the outer layer portion of the instep-side covering portion 211, or may be knitted with yarn different from the yarn constituting the outer layer portion of the instep-side covering portion 211.

(4) Ankle Covering Portion

The ankle covering portion 240 is a portion for covering the ankle, and extends upward from the front upper end of the foot covering portion 210 as shown in FIGS. 10 and 11. The ankle covering portion 240 is located below the lower leg covering portion 250.

The inner layer portion of the ankle covering portion 140 may be formed with an interwoven fabric (knitted fabric) of the above-described core-sheath yarn and the water-absorbent and quick-drying yarn similarly to the inner layer portion of the instep-side covering portion 211, or may be knitted with another knitted fabric (for example, Zoki knitting or the like). The inner layer portion may be knitted with the same yarn as the yarn constituting the inner layer portion of the instep-side covering portion 211, or may be knitted with yarn different from the yarn constituting the inner layer portion.

Conversely, the outer layer portion of the ankle covering portion 240 may be formed with an interwoven fabric (knitted fabric) of the above-described core-sheath yarn and the above-described crimped yarn similarly to the outer layer portion of the instep-side covering portion 211, or may be knitted with another knitted fabric (for example, a Zoki stitch or the like). The outer layer portion may be knitted with the same yarn as the yarn constituting the outer layer portion of the instep-side covering portion 211, or may be knitted with yarn different from the yarn constituting the outer layer portion of the instep-side covering portion 211.

(5) Lower Leg Covering Portion

The lower leg covering portion 250 is a tubular portion for covering the lower leg portion, and extends upward from the upper ends of the Achilles tendon covering portion 230 and the ankle covering portion 240, as shown in FIGS. 10 and 11. The lower leg covering portion 250 is preferably formed in a tapered shape in which its width gradually increases from the ankle covering portion side toward the wearing opening portion side.

The inner layer portion of the lower leg covering portion 250 may be formed with an interwoven fabric (knitted fabric) of the above-described core-sheath yarn and the water-absorbing and quick-drying yarn similarly to the inner layer portion of the instep-side covering portion 211, or may be knitted with another knitted fabric (for example, a Zoki stitch or the like). The inner layer portion may be knitted with the same yarn as the yarn constituting the inner layer portion of the instep-side covering portion 211, or may be knitted with yarn different from the yarn constituting the inner layer portion.

Conversely, the outer layer portion of the lower leg covering portion 250 may be formed with an interwoven fabric (knitted fabric) of the above-described core-sheath yarn and the above-described crimped yarn similarly to the outer layer portion of the instep-side covering portion 211, or may be knitted with another knitted fabric (for example, a Zoki stitch or the like). The outer layer portion may be knitted with the same yarn as the yarn constituting the outer layer portion of the instep-side covering portion 211, or may be knitted with yarn different from the yarn constituting the outer layer portion of the instep-side covering portion 211.

(6) Thigh Covering Portion

The thigh covering portion 260 is a tubular portion for covering the thigh (a portion from above the knee to the crotch), and extends upward from the upper end of the lower leg covering portion 250, as shown in FIG. 10. The thigh covering portion 260 is preferably tapered so that its width gradually increases from the lower leg covering portion side toward the panty portion side.

The inner layer portion of the thigh covering portion 260 may be formed with an interwoven fabric (knitted fabric) of the above-described core-sheath yarn and the water-absorbing and quick-drying yarn similarly to the inner layer portion of the instep-side covering portion 211, or may be knitted with another knitted fabric (for example, Zoki knitting or the like). The inner layer portion may be knitted with the same yarn as the yarn constituting the inner layer portion of the instep-side covering portion 211, or may be knitted with yarn different from the yarn constituting the inner layer portion.

Conversely, the outer layer portion of the thigh covering portion 260 may be formed with an interwoven fabric (knitted fabric) of the above-described core-sheath yarn and the above-described crimped yarn similarly to the outer layer portion of the instep-side covering portion 211, or may be knitted with another knitted fabric (for example, Zoki knitting or the like). The outer layer portion may be knitted with the same yarn as the yarn constituting the outer layer portion of the instep-side covering portion 211, or may be knitted with yarn different from the yarn constituting the outer layer portion of the instep-side covering portion 211.

(7) Panty Portion

The panty portion 270 is a portion for covering a part or all of the region from the crotch to the waist. As shown in FIGS. 10 and 11, the thigh covering portions 260 extend downward from both sides of the panty portion 270 in the right-left direction.

The inner layer portion of the panty portion 270 may be formed with an interwoven fabric (knitted fabric) of the above-described core-sheath yarn and the water-absorbing and quick-drying yarn similarly to the inner layer portion of the instep-side covering portion 211, or may be knitted with another knitted fabric. The inner layer portion may be knitted with the same yarn as the yarn constituting the inner layer portion of the instep-side covering portion 211, or may be knitted with yarn different from the yarn constituting the inner layer portion.

Conversely, the outer layer portion of the panty portion 270 may be formed with an interwoven fabric (knitted fabric) of the above-described core-sheath yarn and the above-described crimped yarn as in the outer layer portion of the instep-side covering portion 211, or may be knitted with another knitted fabric. The outer layer portion may be knitted with the same yarn as the yarn constituting the outer layer portion of the instep-side covering portion 211, or may be knitted with yarn different from the yarn constituting the outer layer portion of the instep-side covering portion 211.

Specific Method for Forming Double-Knitted Tights According to Second Embodiment of the Present Invention The double-knitted tights 200 may be formed in a variety of ways, but are preferably formed by knitting a knitted fabric.

Examples of Such a Method Include (i) a method of knitting the outer layer by knitting from the thigh covering portion side to the tip covering portion TP' of the foot covering portion 210, then knitting the inner layer starting from the tip portion side of the foot covering portion 210 to the thigh covering portion 260, then pushing the inner layer into the outer layer, and then sewing the thigh covering portion 260 to the panty portion 270 with connecting yarn or bonding them with a heat-fusible tape or the like, (ii) a method of knitting an inner layer by knitting from the side of the thigh covering portion to the tip covering portion TP' of the foot covering portion 210, then knitting an outer layer by knitting from the side of the tip portion of the foot covering portion 210 to the thigh covering portion 260, then pushing the inner layer into the outer layer, and then sewing the thigh covering portion 260 to the panty portion 270 with connecting yarn or bonding them with a heat-fusible tape or the like, (iii) a method of knitting an outer layer by knitting from the tip end side of the foot covering portion 210 to the thigh covering portion 260, then knitting an inner layer by knitting from the thigh covering portion side to the tip covering portion TP' of the thigh covering portion 210, then pushing the inner layer into the outer layer, and then sewing the thigh covering portion 260 to the panty portion 270 with connecting yarn or bonding them with a heat-fusible tape, (iv) a method of knitting an inner layer by knitting from the tip end side of the foot covering portion 210 to the thigh covering portion 260, then knitting an outer layer by knitting from the thigh covering portion side to the tip end covering portion TP' of the foot covering portion 210, then pushing the inner layer into the outer layer, and then sewing the thigh covering portion 260 to the panty portion 270 with connecting yarn or bonding them with a heat-fusible tape, (v) a method of knitting an outer layer by knitting from the panty side to the tip covering portion TP' of the foot covering portion 210, then knitting an inner layer by knitting from the tip side of the foot covering portion 210 to the panty portion, then pushing the inner layer into the outer layer, and then sewing the panty portions with connecting yarn after cutting the inner side of the panty portion in the longitudinal direction, or bonding them with a heat-fusible tape, (vi) a method of knitting an inner layer by knitting from the panty side to the tip covering portion TP' of the foot covering portion 210, then knitting an outer layer by knitting from the tip side of the foot covering portion 210 to the panty portion, then pushing the inner layer into the outer layer, and then sewing the panty portions with connecting yarn after cutting the inner side of the panty portion in the longitudinal direction or bonding them with a heat-fusible tape, (vii) a method of knitting an outer layer by knitting from the tip end side of the foot covering portion 210 to the panty portion, then knitting an inner layer by knitting from the panty portion side to the tip end covering portion TP' of the foot covering portion 210, then pushing the inner layer into the outer layer, and then sewing the panty portions with connecting yarn after cutting the inner side of the panty portion in the longitudinal direction or bonding them with a heat-fusible tape, (viii) a method of knitting an inner layer by knitting from the tip of the foot covering portion 210 to the panty portion, then knitting an outer layer by knitting from the panty portion to the tip covering portion TP' of the foot covering portion 210, then pushing the inner layer into the outer layer, and then sewing the panty portions with connecting yarn after cutting the inner side of the panty portion in the longitudinal direction or bonding them with a heat-fusible tape, (ix) a method of starting knitting of the leg portion from the boundary between the panty portion 270 and the thigh covering portion 260, then finishing knitting of the panty portion 270, and then sewing the panty portions with connecting yarn or bonding them with a heat-fusible tape or the like, (x) a method of starting knitting of the panty portion from the boundary between the panty portion and the leg portion, then finishing knitting of the panty portion, and then sewing the panty portions with connecting yarn or bonding them with a heat-fusible tape or the like, (xi) a method of knitting an outer layer by knitting from the panty portion side to the tip covering portion TP' of the foot covering portion 210 by using a weft knitting machine for a whole garment or the like, then knitting an inner layer by knitting from the tip portion side of the foot covering portion 210 to the panty portion, and then pushing the inner layer into the outer layer, (xii) a method of knitting an inner layer by knitting from the panty portion side to the tip covering portion TP' of the foot covering portion 210 by using a weft knitting machine for a whole garment or the like, then knitting an outer layer by knitting from the tip portion side of the foot covering portion 210 to the panty portion, and then pushing the inner layer into the outer layer, (xiii) a method of knitting an outer layer by knitting from the tip portion side of the foot covering portion 210 to the panty portion by using a weft knitting machine for a whole garment or the like, then knitting an inner layer by knitting from the panty portion side to the tip covering portion TP' of the foot covering portion 210, and then pushing the inner layer into the outer layer, (xiv) a method of knitting an inner layer by knitting from the tip portion side of the foot covering portion 210 to the panty portion by using a weft knitting machine for a whole garment or the like, then knitting an outer layer by knitting from the panty portion side to the tip covering portion TP' of the foot covering portion 210, and then pushing the inner layer into the outer layer, (xv) a method of knitting an inner layer and an outer layer separately, then pushing the inner layer into the outer layer, and then sewing the inner layer portion and the outer layer portion of the tip covering part TP' of the foot covering portion 210 with connecting yarn or bonding them with a heat-fusible tape or the like, and further sewing the thigh covering portion 260 to the panty portion 270 with connecting yarn or bonding them with a heat-fusible tape or the like, and (xvi) a method of knitting an inner layer and an outer layer separately, then pushing the inner layer into the outer layer, and then detachably fastening the thigh covering portion 260 to the panty portion 270 with a hook, a button, or the like.

Note that the methods described in (i) through (iV) above are to knit the panty and leg portions separately, and then join the panty and leg portions, whereas the methods described in (v) through (x) are to knit the left side and right side portions separately, and then join the left and right panty portions. Examples of methods of forming the panty portion also include a method of sandwiching a gusset between cylindrical bodies to form the panty portion three-dimensionally. In any of the above methods, it is necessary to close the toe of the foot covering portion 210 and secure the end of the knitting by sewing or fusing to prevent it from unraveling.

As a knitting machine used for knitting the double-knitted tights 200, for example, a four-inch size knitting machine having the number of stitches of 320N to 360N is preferably used.

Characteristics of Double-Knitted Tights According to Second Embodiment of the Present Invention The double-knitted tights 200 according to the second embodiment of the present invention has the above-described configuration, and thus has excellent heat retention properties and excellent water-absorbing and quick-drying properties. This allows the double-knitted tights 200 to have excellent heat retention properties, and furthermore allows the feet and legs of the person wearing the double-knitted tights 200 to be less likely to get stuffy.

In the double-knitted tights 200, the outer layer portion of the bottom-side covering portion 212 of the foot covering portion 210 is knitted by pseudo-pile knitting. This causes the air above the low-bulk region to flow and diffuse due to the air flow and diffusion effect of the bulky region every time the wearer steps on the bottom-side covering portion 212. Thus, the double-knitted tights 200 allows air warmed in the sock to flow and diffuse during walking or the like, thereby allowing for warming a relatively wide foot region. In addition, the air in the system, the humidity of which has been increased by the flow and diffusion of the air, is gradually discharged to the outside of the system, thereby making it less likely for the foot of the wearer to become stuffy.

Modification (A)

In the double-knitted tights 200 according to the second embodiment, the bag-shaped tip covering portion TP' is formed by the instep-side tip portion 211*t* and the bottom side tip portion 212*t*; however, the toe bag portion for covering each or several toes of the foot may be formed by the instep-side tip portion and the bottom-side tip portion.

(B)

In the second embodiment, the double-knitted tights 200 according to the second embodiment are taken up to describe an example of the multi-knitted wearable garment;

however, the multi-knitted wearable garment should not be limited to the double-knitted tights 200 according to the second embodiment, and may be a multi-knitted tights of triple knitting or more.

(C)

In the double-knitted tights 200 according to the second embodiment, the inner layer portion of the instep-side covering portion 211 of the foot covering portion 210 is formed with the interwoven fabric (knitted fabric) of the core-sheath yarn and the water-absorbing and quick-drying yarn described above: however, when the inner layer portion of the bottom-side covering portion 212 is knitted with such yarn, the inner layer portion of the instep-side covering portion 211 may be formed with an interwoven fabric of yarn having moisture-absorbent heat-generating properties and water-absorbing and quick-drying yarn.

(D)

The double-knitted tights 200 according to the second embodiment have a two-layer structure as a whole, but only the tip portion of the foot covering portion of the tights may have a two-layer structure. In such a case, a portion other than the tip portion may have a single-layer structure, and the portion may be knitted into any knitted fabric (for example, plain knitting, mesh knitting, tuck knitting, full-face pile knitting, border pile knitting, zokki knitting, or the like). When a portion other than the tip portion is knitted by the Zoki knitting, the panty portion may be knitted with a knitted fabric other than the Zoki knitting. In such a case, the panty portion is preferably knitted with a pseudo pile knitted fabric. Preferred examples of such a pseudo pile knitted fabric include a tucked pseudo pile knitted fabric (bulky knitted fabric) that is an interwoven fabric (knitted fabric) of the above-described core-sheath yarn and the above-described crimped yarn. In such a case, the example of bifurcating the gore lines GL into the Y shape in the modification (M) of the first embodiment may be applied.

(E)

The technique applied to the double-knitted tights 200 according to the second embodiment may be applied to double-knitted pantyhose. When single covered yarn is used as the core-sheath yarn, the core yarn preferably has a denier number within a range from 20 to 40 inclusive, and the sheath yarn preferably has a denier number within a range from 10 to 20 inclusive. As a knitting machine used for knitting the double-knitted panty hose, for example, a four-inch size knitting machine having the number of stitches of 360N to 400N is preferably used.

The above-described modifications may be employed alone or in combination as appropriate as long as there is no contradiction.

The present invention will be described in more detail below with reference to examples.

Examples (1) Manufacture of Double-Knitted Sock (1-1) Selection of Yarn

Rayon acrylic yarn (rayon 60%/acrylic 40%) was used as the front yarn constituting the inner layer portion (skin-side portion) other than the tip covering portion TP, and deodorant yarn was used as the back yarn thereof. Rayon acrylic yarn (rayon 60%/acrylic 40%) was used as the front yarn constituting the outer layer portion (outer side portion) of the tip covering portion TP, and deodorant yarn was used as the back yarn thereof. High multi-polyester yarn (water-absorbing modified type) was used as the front yarn constituting the inner layer portion (skin-side portion) of the tip covering TP, and deodorant yarn was used as the back yarn thereof.

(1-2) Knitting

Portions other than the tip covering portion TP were knitted by thin pile knitting in accordance with a usual method (that is, the portions other than the tip covering portion TP have a single-layer structure). The inner layer portion (skin side portion) of the tip covering portion TP was entirely knitted by plain knitting according to a usual method, the outer layer portion (outer side portion) of the instep-side tip portion 111*t* was knitted by full-face pile knitting according to a usual method: the outer layer portion (outer side portion) of the bottom-side tip portion 112*t* was knitted by border pile knitting according to a usual method: and the outer layer portion (outer portion) of the bottom-side tip portion 112*t* was knitted by a border pile knitting according to the usual method. Note that the border pile knitting was knitted by combining pile knitting and plain knitting. The pile portion in the full-face pile knitting and the border pile knitting was knitted so as to face the inner layer side.

(2) Measurement of Sock Interior Environment Data of Double Knitted Sock

Figure 13:
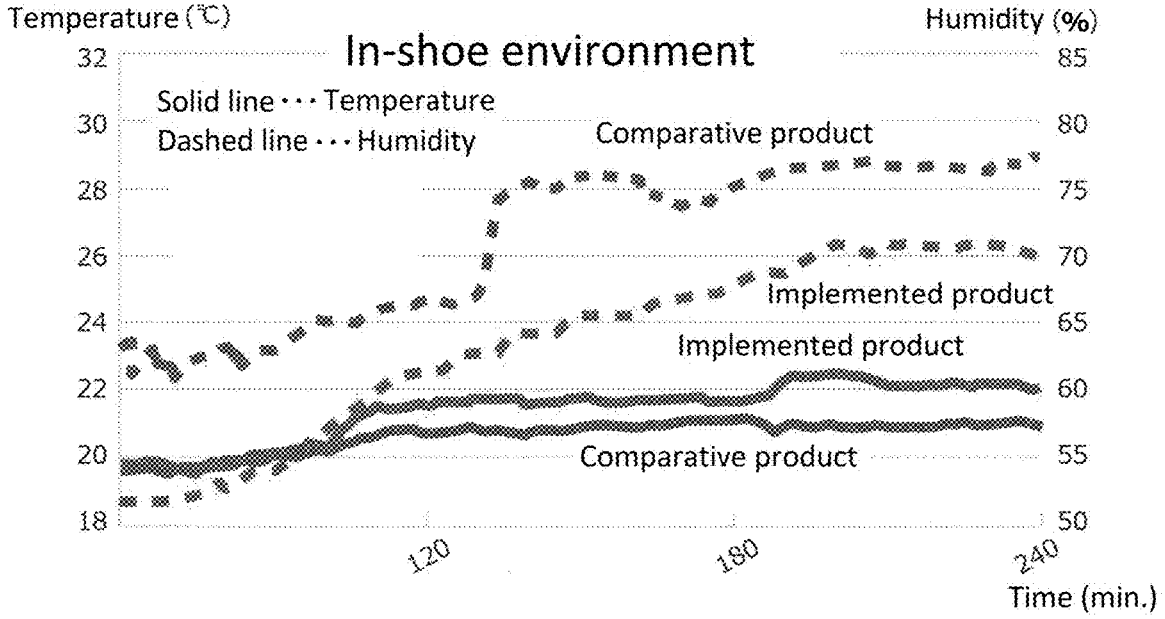
FIG. 13 is a graph for comparing the environment inside a shoe of the double-knitted sock manufactured in Example 1 and the environment inside a sock of a comparative product.

After a temperature and humidity sensor was attached to the skin of the root portion on the instep side between the first toe and the second toe of each foot, the above-described double-knitted sock was worn on the right foot, and a thick sock as a comparative product was worn on the left foot. Next, a sneaker was put on each foot, and the temperature and humidity inside the sock were measured when the sock was worn for four hours under the following environment. As a result, the graph shown in FIG. 13 was obtained. The comparative sock was a sock knitted in a single all-pile stitch, and the constituent yarn thereof were polypropylene yarn, acrylic yarn, wool yarn, and other yarn.

Records

Temperature: 9° C. (average temperature in December) until one hour has elapsed, and 15° C. to 20° C. thereafter Humidity: about 30%

Place of Execution: Office in Nara prefecture

The graph clarifies that the double-knitted sock according to the present example can not only keep the temperature in the shoe high but also reduce or inhibit the humidity in the shoe as compared with the comparative product. Thus, the double-knitted sock is excellent in heat retention properties and can make the foot of the wearer less likely to get stuffy.

What is claimed is:

1. A multi-knitted wearable garment comprising:

at least one first knitted fabric layer including a region formed with a bulky knitted fabric, wherein a bulky portion of the bulky knitted fabric is configured to extend to a foot of a user of the garment, and wherein a pile portion of the bulky knitted fabric faces an inner layer side of the garment; and at least one second knitted layer including a region formed with a water-absorbing and quick-drying knitted fabric having a higher water-absorbing and quick-drying property than the region formed with the bulky knitted fabric.

2. The multi-knitted wearable garment according to claim 1, wherein the multi-knitted wearable garment can be worn at least on a foot, and the first knitted fabric layer constitutes a bottom covering portion that is configured to cover a bottom side of the foot of the user of the garment.

3. The multi-knitted wearable garment according to claim 2, wherein the first knitted fabric layer is positioned in an outermost layer of the bottom covering portion.

4. The multi-knitted wearable garment according to claim 1, wherein the multi-knitted wearable garment can be worn at least on a foot, and the first knitted fabric layer and second knitted fabric layer are provided only in a tip covering portion that is configured to cover a tip portion of the foot of the user of the garment.

5. The multi-knitted wearable garment according to claim 1, further comprising at least one third knitted fabric layer including a region formed with a partially bulky knitted fabric.

6. The multi-knitted wearable garment according to claim 5, wherein a bulky portion of the partially bulky knitted fabric is configured to extend towards a foot of the user of the garment.

7. The multi-knitted wearable garment according to claim 5, wherein the at least one third knitted fabric layer is knitted by pseudo pile knitting formed by interknitting (A) a plain knitting course with core-sheath yarn having stretchability and bulkiness in which sheath yarn covers core yarn and (B) a tuck knitting course with crimped yarn having stretchability and bulkiness.

8. The multi-knitted wearable garment according to claim 5, wherein the multi-knitted wearable garment can be worn at least on the foot of the user of the garment, and the at least one third knitted fabric layer constitutes a bottom covering portion that is configured to cover a bottom side of the foot of the user of the garment.

9. The multi-knitted wearable garment according to claim 5, wherein the partially bulky knitted fabric includes at least one bulky region and a low-bulk region having a lower bulk than the at least one bulky region.

10. The multi-knitted wearable garment according to claim 9, wherein the low-bulk region is adjacent to at least two bulky regions.

11. The multi-knitted wearable garment according to claim 10, wherein the at least one bulky region and the low-bulk region are both band-shaped, and the low-bulk region is on both sides of the at least one bulky region in a lateral direction.

12. The multi-knitted wearable garment according to claim 5, wherein the multi-knitted wearable garment can be worn at least on a foot, and the first knitted fabric layer, the second knitted fabric layer, and the at least one third knitted fabric layer are provided only in a tip covering portion that is configured to cover a tip portion of the foot of the user of the garment.

13. The multi-knitted wearable garment according to claim 11, wherein the first knitted fabric layer is an interwoven fabric layer of (a) core-sheath yarn having stretchability and bulkiness in which sheath yarn covers core yarn and (b) crimped yarn having stretchability and bulkiness, the second knitted fabric layer is an interwoven fabric layer of the core-sheath yarn and water-absorbing and quick-drying yarn, and the at least one third knitted fabric layer is an interwoven fabric layer of the core-sheath yarn and the crimped yarn.

14. The multi-knitted wearable garment according to claim 1, further comprising:

at least one fourth knitted fabric layer including a region formed with a moisture-absorbent heat-generating knitted fabric having moisture-absorbent heat-generating properties, wherein the moisture-absorbent heat-generating knitted fabric is knitted with yarn having moisture-absorbent heat-generating properties, the water-absorbing and quick-drying knitted fabric is knitted with yarn including water-absorbing and quick-drying yarn, and one of the second knitted fabric layer and the at least one fourth knitted fabric layer is positioned in an innermost layer.

15. The multi-knitted wearable garment according to claim 1, wherein the water-absorbing and quick-drying knitted fabric is knitted with front yarn and back yarn, the front yarn includes yarn having moisture-absorbent heat-generating properties or water absorbing and quick-drying yarn, and when the front yarn includes the yarn having moisture-absorbent heat-generating properties, the back yarn includes the water-absorbing and quick-drying yarn, and when the front yarn includes water-absorbing and quick-drying yarn, the back yarn includes the yarn having moisture-absorbent heat-generating properties.

16. The multi-knitted wearable garment according to claim 1, wherein the water-absorbing and quick-drying knitted fabric is an interwoven fabric of yarn having moisture-absorbent heat-generating properties and water-absorbing and quick-drying yarn.

* * * * *